US009266030B2

(12) United States Patent
Graube

(10) Patent No.: US 9,266,030 B2
(45) Date of Patent: Feb. 23, 2016

(54) MODULAR SYSTEMS FOR THE CONSTRUCTION OF THREE-DIMENSIONAL STRUCTURES OF ARBITRARY SIZE AND SHAPE

(71) Applicant: August Graube, Seattle, WA (US)

(72) Inventor: August Graube, Seattle, WA (US)

(73) Assignee: Formal Frog LLC, Seattle, WA (US)

( * ) Notice: Subject to any disclaimer, the term of this patent is extended or adjusted under 35 U.S.C. 154(b) by 0 days.

(21) Appl. No.: 14/622,713

(22) Filed: Feb. 13, 2015

(65) Prior Publication Data

US 2015/0321113 A1 Nov. 12, 2015

Related U.S. Application Data

(60) Provisional application No. 61/995,728, filed on Apr. 18, 2014.

(51) Int. Cl.
*A63H 33/00* (2006.01)
*A63H 33/04* (2006.01)

(52) U.S. Cl.
CPC ..... *A63H 33/04* (2013.01)

(58) Field of Classification Search
USPC ..... 446/85, 102, 108, 109, 111, 112, 115, 446/116, 124
See application file for complete search history.

(56) References Cited

U.S. PATENT DOCUMENTS 2,733,786 A * 2/1956 Drake ..... A47B 96/1408 403/388
2,776,521 A * 1/1957 Zimmerman ..... A63H 33/065 16/227
4,509,930 A * 4/1985 Schweigert ..... A63H 33/065 220/4.29
4,685,892 A * 8/1987 Gould ..... A63H 33/062 446/109
4,886,477 A * 12/1989 Ziegler ..... A63H 33/065 446/104
5,472,365 A * 12/1995 Engel ..... A63H 33/04 403/170
8,939,767 B2 * 1/2015 Driskell ..... 434/211
2008/0220689 A1 * 9/2008 Mimlitch ..... A63H 33/042 446/91
2010/0130094 A1 5/2010 Michalk et al.
2012/0028534 A1 * 2/2012 Unger ..... F16B 2/22 446/111
2013/0165012 A1 * 6/2013 Klauber ..... A63H 33/062 446/91
2014/0235133 A1 * 8/2014 Ksobiech ..... A63H 33/08 446/124

* cited by examiner

*Primary Examiner* — Kurt Fernstrom
(74) *Attorney, Agent, or Firm* — Jeffrey D. Patterson; Lowe Graham Jones, PLLC

(57) ABSTRACT

Modular systems for the construction of three-dimensional structures are disclosed. A system includes a first panel, a second panel, and a fixing member. The first panel includes a first edge and a first attachment member. The second panel includes a second edge and a second attachment member. The second edge is configured to mate with the first edge of the first panel. This mating forms a hinge that couples the first and the second panels and enables a relative rotation about a rotation axis through the hinge. The relative rotation defines a relative angle between the first and the second panels. The fixing member is configured to couple to each of the first and the second attachment members when the relative angle between the first and the second panels is equivalent to a first angle, fixing the relative angle at the first angle and forming the structure.

20 Claims, 24 Drawing Sheets

MODULAR SYSTEMS FOR THE CONSTRUCTION OF THREE-DIMENSIONAL STRUCTURES OF ARBITRARY SIZE AND SHAPE

PRIORITY CLAIM

This patent application claims priority to U.S. Provisional Patent Application No. 61/995,728, entitled FORT BUILDING TOY, filed on Apr. 18, 2014, the contents of which are hereby incorporated by reference.

FIELD OF THE INVENTION

The field of the invention relates generally to modular building blocks. The invention relates more particularly to systems for constructing rigid three-dimensional structures of arbitrary shape, size, and form from modular building blocks.

BACKGROUND OF THE INVENTION

Various toy building blocks are available for consumers. However, many existing building blocks are bulky and utilize a large amount of space when storing or shipping. To build large-scale and complex structures, such as airplanes, cars, houses, castles, boats, rocket ships, and the like, the interconnecting blocks must include a certain level of structural integrity. Furthermore, to build such structures, a builder must be able to interconnect the building blocks at various angles. It is desirable to enable the builder to customize individual building blocks with graphics. It is for these and other considerations that the following disclosure is provided.

SUMMARY OF THE INVENTION

Modular systems, kits, and assemblies for the construction of three-dimensional structures of arbitrary size and shape are disclosed. In one embodiment, a modular system for forming a rigid structure includes a first panel, a second panel, and a fixing member. The first panel includes a first edge and a first attachment member. The second panel includes a second edge and a second attachment member. The second edge is configured and arranged to mate with the first edge of the first panel. This mating forms a hinge that couples the first and the second panels and enables a relative rotation about a rotation axis through the hinge. The relative rotation defines a relative angle between the first and the second panels. The fixing member is configured and arranged to couple to each of the first and the second attachment members when the relative angle between the first and the second panels is substantially equivalent to a first angle, fixing the relative angle at the first angle and forming at least part of the rigid structure. The first angle is greater than 90° and less than 180°.

In at least one embodiment, the second panel further includes a third attachment member. The fixing member is further configured and arranged to couple to each of the first and the third attachment members when the relative angle between the first and the second panels is substantially equivalent to a second angle, fixing the relative angle at the second angle. The first panel may further include a first channel that is substantially orthogonal to the first edge and the first attachment member is positioned within the first channel. In various embodiments, the first edge of the first panel includes a male coupler and the second edge of the second panel includes a female coupler. The female coupler is configured and arranged to receive the male coupler. When the female coupler receives the male coupler, the male and the female couplers form the hinge that couples the first and second panels.

The fixing member includes a first coupler that is configured and arranged to receive the first attachment member of the first panel and a second coupler that is configured and arranged to receive the second attachment member of the second panel. In a preferred embodiment, the system further includes a planar member. The planar member includes a footprint that is substantially equivalent to a footprint of the first panel. Data may be embedded on the footprint of the planar member. The first panel includes a coupler that is configured and arranged to couple the planar member to the first panel. The planar member may be cardboard stock. The planar member may include a dry-erase or chalk board element. The planar member may include a decorative graphic. The planar surface may include a surface that a user can customize, such as by drawing on with chalk, dry erase marker, or the like. In various embodiment, a kit for constructing a three-dimensional (3D) structure includes a first substantially planar member, a second substantially planar member, and a connector member. The first planar member includes a first fastener and a first edge. The second planar member includes a second fastener, a third fastener, and a second edge. The second planar member is configured and arranged to rotatably couple to the first planar member along an interface between the first edge of the first planar member and the second edge of the second planar member. Coupling the planar members forms at least part of the 3D structure that includes a relative angle between the coupled first and second planar members. When the connector member is connected to each of the first fastener of the of the first planar member and the second fastener of the second planar member, the relative angle between the coupled first and second planar members is fixed at a first angle. When the connector member is connected to each of the first fastener and the third fastener of the second planar member, the relative angle is fixed at a second angle.

In at least one embodiment, the first fastener of the first planar member is a bar fastener. The connector member is configured and arranged to provide tactile feedback when connecting to the first fastener of the first planar member. The first edge of the first planar member includes a first notch. The second edge of the second planar member includes a second notch. The connector member includes a reinforcing lip. The first and the second notches form an aperture along the interface between the first and the second edges. The aperture is configured and arranged to receive the reinforcing lip when the relative angle between the coupled first and second planar members is substantially equivalent to 180°. When received by the aperture, the reinforcing lip reinforces the 3D structure.

In a preferred embodiment, the second planar member further includes a fastener aperture, wherein each of the second and the third fasteners are positioned within the fastener aperture. The second planar member may further include a first marking positioned adjacent the second fastener and a second marking positioned adjacent the third fastener. The first marking indicates the first angle and the second marking indicates the second angle. The first planar member may further include a reinforcing rib that is transverse to the first edge and reinforces the first planar member.

In at least one embodiment, a modular assembly includes a first substantially rectangular module, a second substantially rectangular module, a hinge, and a locking device. The rectangular modules may be square panels or planar members. The first rectangular module includes a first edge. The second rectangular module includes a second edge. The hinge is configured and arranged to rotatably couple the first and the second rectangular modules along the first and the second edges. The locking device is configured and arranged to inhibit a relative rotation about the hinge and between the first and the second rectangular modules when the locking device is coupled to each of the first and the second rectangular modules.

In various embodiments, the locking device locks a relative angle between the first and the second rectangular modules at a first angle when coupled to each of the first and the second rectangular modules in a first configuration. The locking device locks the relative angle at a second angle when coupled to each of the first and the second rectangular modules in a second configuration.

In at least one embodiment, the hinge is further configured and arranged to provide tactile feedback when the first and second rectangular modules are coupled or de-coupled. The assembly may further include a graphic component that is configured and arranged to be attached to the first rectangular module. The first and the second rectangular modules are constructed from a plastic material. The hinge includes a male connector positioned along the first edge of the first rectangular module and a female connector positioned along the second edge of the second rectangular module. In a preferred embodiment, the first and the second configurations of the locking device coupled to the first and the second rectangular modules is based on the relative positions of a plurality of attachment members included in the first rectangular module and a second plurality of attachment members included in the second rectangular module.

BRIEF DESCRIPTION OF THE DRAWINGS

Preferred and alternative examples of the present invention are described in detail below with reference to the following drawings:

FIGS. 13A-13B illustrate other three-dimensional configurations of three panels.

DETAILED DESCRIPTION OF THE PREFERRED EMBODIMENTS

This disclosure presents systems, kits, assemblies, and modular components for the formation of three-dimensional structures. In a preferred embodiment, the systems, kits, and assemblies are provided as modular construction toys to enable the construction of three-dimensional rigid structures. The structures are formed by building up geometric shapes that include angles not limited to right angles. Such rigid structures may include, but are not otherwise limited to various forms of forts, castles, houses, and toy vehicles such as toy spacecraft, aircraft, and watercraft. Although the preferred embodiments include the construction of toy-like structures for amusement, other embodiments are not so constrained. For instance, it should be understood that by varying the size, material, and structural integrity of the modular components included in the systems, kits, and assemblies, more stable and/or more practical modular constructions may be formed with other embodiments. These more practical constructions may include, but are otherwise not limited to temporary housing units, modular shelters, and mobile military, medical, or emergency facilities The systems, kits, and assemblies include modular components including a plurality of modular planar members and a plurality of modular fixing members. The planar members may include panels, rectangular modules, building blocks, main parts, and the like. The fixing members may include connector members, locking devices, clips, and the like. To enable the modularity of the systems, in preferred embodiments, each of the included planar members is substantially equivalent to the other included planar members. Likewise, each of the included fixing members is substantially equivalent to the other included fixing members.

Figure 12:
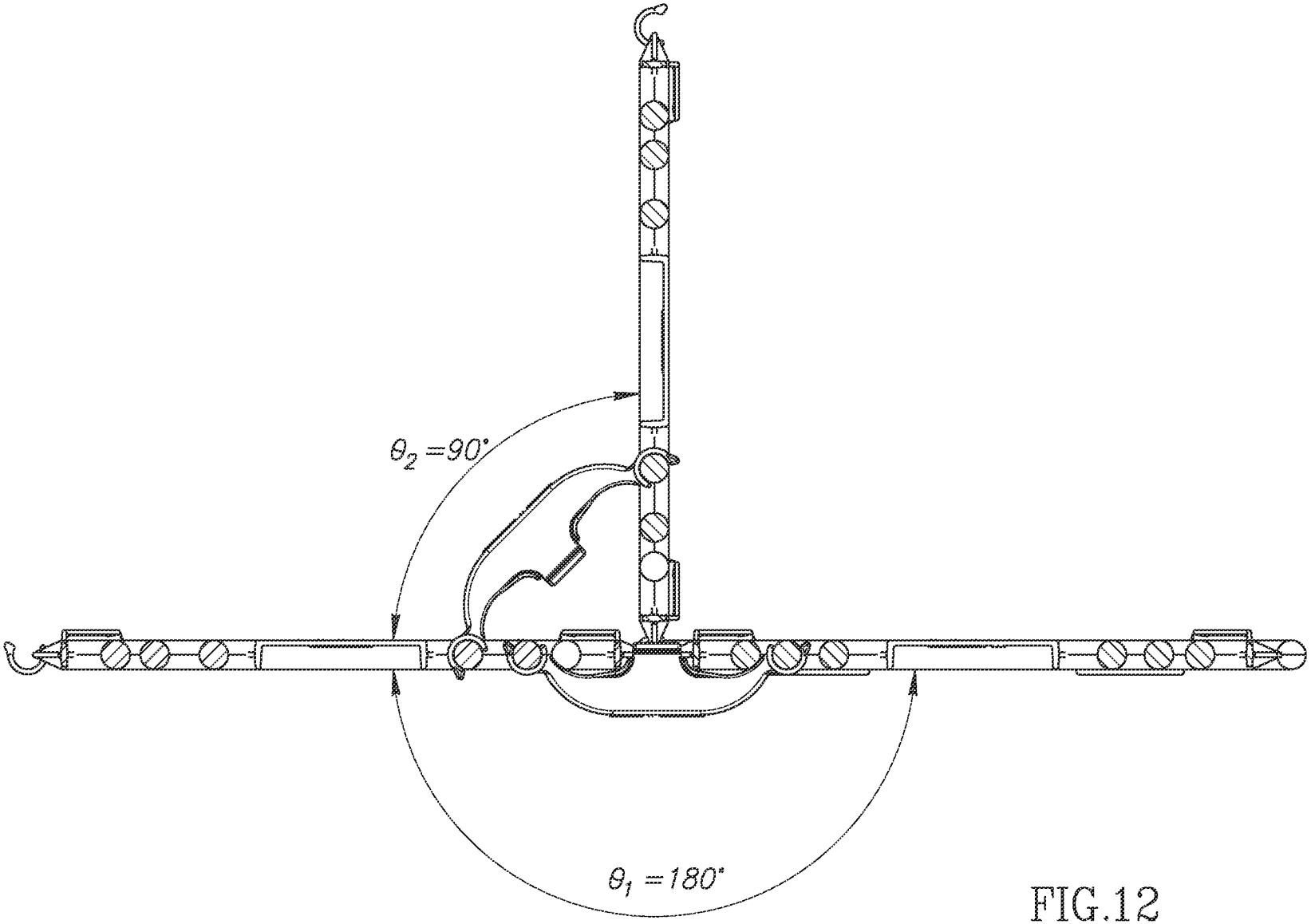
FIG. 12 shows the coupling of three panels to form a three-dimensional structure.

Each modular panel is configured and arranged to rigidly couple to any other included panel. Each panel includes four panel edges of equal length. Each edge of each panel includes at least one coupler. In preferred embodiments, each edge includes at least two couplers. The couplers along the panel edges enable a user to couple a panel to any edge of any other panel, coupling the two panels along the panel edges. Such a coupling forms a joint or interface that is positioned along the edges and between the two panels. Additionally, a panel may be coupled to up to four other panels along its edges: one along each of the four edges. Furthermore, as shown in FIGS. 12-13B, additional panels may be coupled in other configurations, so that more than four panels may be coupled to any individual panel. Coupling a plurality of panels enables the formation of a structure that is limited in size only by the total number of available panels in the kits or systems.

When two panels are coupled along adjacent panel edges, interlocked couplers or edge connectors form a hinge, enabling the relative rotation of each of the panels about an axis defined by the adjacent panel edges and hinge. By selectively coupling one of the included modular fixing members to both a first location of one of the panels and to a second location of the other panel, the relative angle between the coupled panels is fixed, locked, or otherwise held constant.

The coupling locations of the panels where the fixing member is coupled or attached to may include attachment members, fasteners, couplers, or the like. By fixing the relative angle between the two panels, the three-dimensional structure becomes rigid and its shape is at least partially constrained and dependent upon the choice of the fixed relative angle between any two adjacent panels included in the multi-panel structure. Accordingly, the choice of the coupling configuration of the fixing member to the panels determines the fixed or locked relative angle of the coupled panels and thus the shape and/or form of the three-dimensional structure.

In a preferred embodiment described herein, the relative angle between the two panels may be fixed at up to seven discreet angles: 35°, 90°, 107°, 115°, 135°, 150°, and 180°. It should be noted that other embodiments are not so constrained, and more or less options for the choices of the selected discreet angles may be provided. The ability to fix the relative angle between each pair of coupled panels enables a user to construct three-dimensional structures of significant diversity in both shape and form. With seven possible angle choices between each pair of coupled panels, the shape of the possible three-dimensional structures is practically limitless. For instance, provided enough panels of the preferred embodiment, a user may construct the igloo-like structure 1600 of FIG. 16A or the fort-like structure 1650 of FIG. 16B. It should be understood that the size, shape, and form of the structures that a user may construct from these modular building blocks or components is practically arbitrary and limited only by the user's imagination and the total number of available panels and fixing members in a provided system or kit.

Figure 16A:
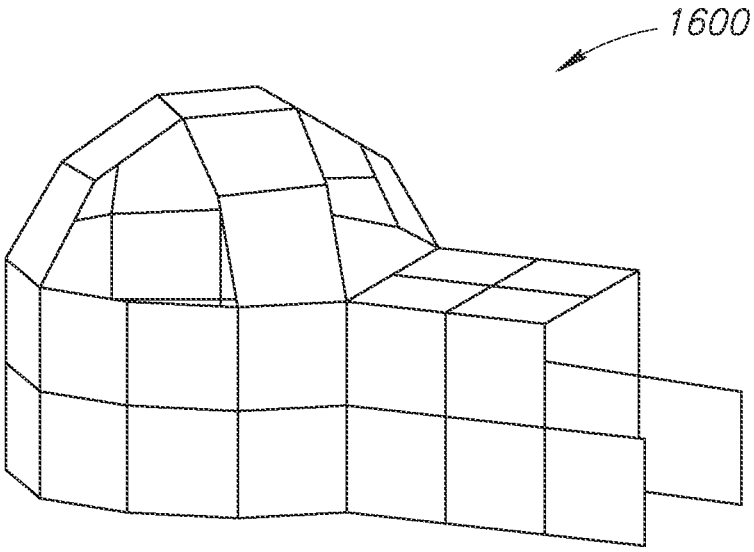
FIGS. 16A-16B illustrates various three-dimensional structures formed by a plurality of panels of FIGS. 1A-1B and fixing members of FIGS. 2A-2B.
Figure 16B:
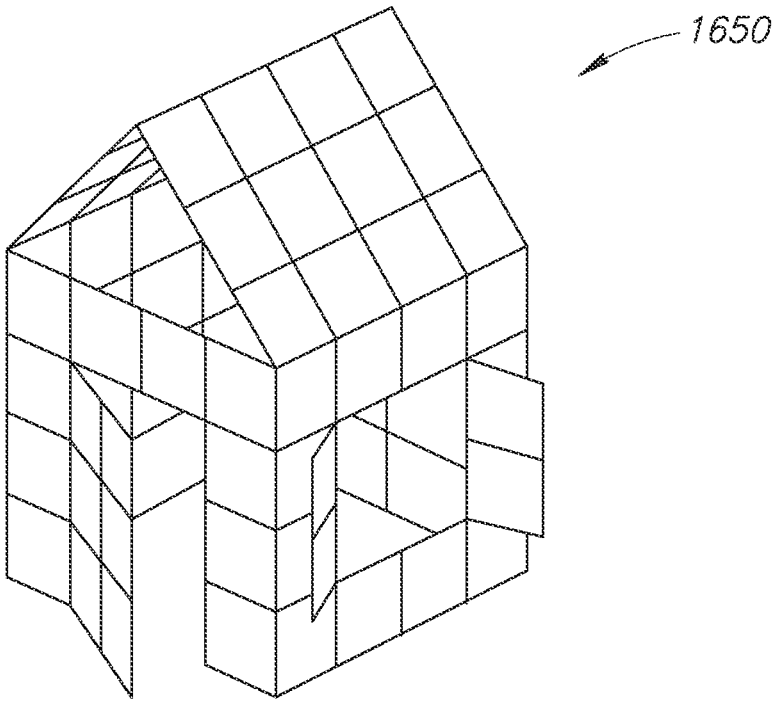

As shown by the fort-like structure 1650 of FIG. 16B, movable structures such as doors and window shutters may be formed by not employing the fixing member to fix the relative angles of certain portions of the formed structure. Rather, a portion of the panels included in such structures is free to rotate about the hinge formed by the coupling of the adjacent panels. No other components or tools are required to form or construct the three-dimensional rigid structures other than the included panels and fixing members. In various embodiments, the kits and systems may also include a planar member that attach to the panels. Attaching such a planar member enables the decorating or customization of individual panels with customizable graphics. Because the kits include panels, planar members, and fixing members, the kits may be packaged neatly into planar or stackable arrays, enabling efficient storing and shipping.

Figure 1A:
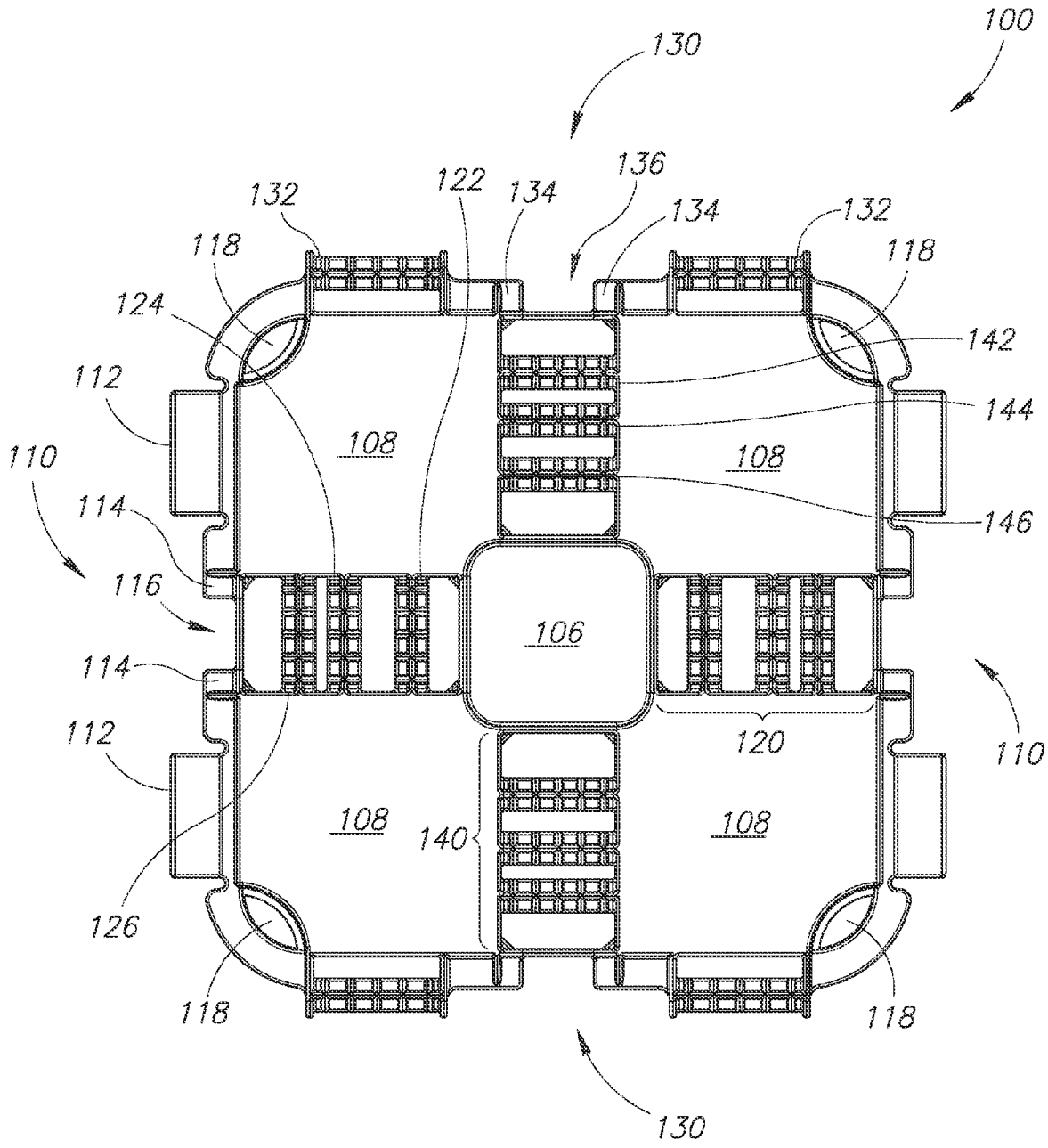
FIG. 1A illustrates a front side view of a component that is consistent with various embodiments disclosed herein.

FIG. 1A illustrates a front side view of a modular component 100 that is consistent with various embodiments disclosed herein. The component 100 is included in the various systems, kits, and assemblies described herein. The component 100 is a square component. The component 100 may be a panel, planar member, rectangular module, building block, main part, or the like. Panel 100 includes a front side, a backside, and four edges: two opposing and substantially parallel male edges 130 and two opposing and substantially parallel female edges 110 that are substantially orthogonal to each of the male edges 130. The male edges 130 are referred to as such because each male edge 130 includes at least one male connector 132. In the preferred embodiment shown in FIG. 1A, the male edges 130 each include two male connectors 132. In at least one embodiment, more than two male connectors 132 are included on each male edge 130.

The two male connectors 132 are positioned symmetrically about and apart from an axis, wherein the axis bisects each of the male edges 130. Embodiments are not constrained by the distance between the two male connectors 132. However, in a preferred embodiment, the midpoint of each male connector 132 is closer to the corresponding corner of panel 100 than to the midpoint of the male edge 130. As shown in FIG. 1A, panel 100 includes rounded and/or curved corers. Rounded corners are beneficial. When four panels are adjoined to create a square structure, the four adjacent rounded corners in the center of the square structure form an aperture. The aperture can receive a digit of the user, such as a thumb, so that the user can better hold and/or manipulate the structure being formed. However, other embodiments are not so constrained and may include corners that are more angular or include other features.

In various embodiments, the male connectors 132 include a bar, cylinder, or other symmetric member that is positioned outboard from the male edge 130 and configured substantially parallel with the male edge 130. An aperture, gap, hole, void, or the like may exist between the male edge 130 and the outboard male connector 132. This gap partially offsets the male connector 132 from the male edge and provides space for mating with a corresponding female connector and forming a rotational hinge, as discussed throughout.

Each of the female edges 110 includes at least one female connector 112. In a preferred embodiment, the number of female connectors 112 on each female edge 110 is equivalent to the number of male connectors 132 on each male edge 130. The female connectors 112 are positioned outboard of the female edges 110 at substantially equivalent positions as the male connectors 132 on the male edges 130.

Each male connector 132 includes a male edge-tab 134 that is positioned between the male connector 132 and the midpoint of the male edge 130. Because the male edge-tabs 134 are symmetrically positioned about the midpoint of male edge 130, the male edge-tabs 132 form a male edge-notch 136 centered about the midpoint of the male edge 130. Likewise, each female edge 110 includes similarly positioned female edge-tabs 114, which form a female edge-notch 116.

For each male edge 130, panel 100 includes an associated male-edge channel 140. Likewise, panel 100 includes an associated female-edge channel 120 for each female edge 110. As shown in FIG. 1A, the four male/female-edge channels 140/120 subdivide panel 100 into a central portion 106 surround by four quadrants 108 and the four edge channels 140/120. Each of the male/female-edge channels 140/120 includes a fastening aperture, trench, hole, void, or the like in panel 100. Each edge channel 140/120 is oriented substantially transverse to the corresponding male/female edge 130/110.

Furthermore, each of the male/female-edge channels 140/120 includes one or more attachment members. These attachment members are associated with the edge 130/110 that corresponds to the particular edge channel 140/120. In the preferred embodiment shown in FIG. 1A, each of the male-edge channels 140 includes three attachment members: a first male-edge attachment member 142, a second male-edge attachment member 144, and a third male-edge attachment member 146. The male-edge attachment members are spaced apart along the axis that bisects the male edges 130.

Note that the first male-edge attachment member 142 is the most outboard attachment member and the third male-edge attachment member 146 is the most inboard attachment member of each of the male-edge attachment members included in male-edge channel 140. The first male-edge attachment member 142 is positioned a first distance inboard from the male edge 130. The second male-edge attachment member 144 is positioned a second distance inboard from the first male-edge attachment member 142. The third male-edge attachment member 146 is positioned a third distance inboard from the second male-edge attachment member 144.

Likewise, the female-edge channels 120 include three similar female-edge attachment members: a first female-edge attachment member 122, a second female-edge attachment member 124, and a third female-edge attachment member 126. The female-edge attachment members are spaced apart along an axis that bisects the female edges 110.

Note that the first female-edge attachment member 122 is the most inboard attachment member and the third female-edge attachment member 126 is the most outboard attachment member of each of the female-edge attachment members included in female edge channel 120. The third female-edge attachment member 126 is positioned a fourth distance inboard from the female edge 110. The second female-edge attachment member 124 is positioned a fifth distance inboard from the third female-edge attachment member 126. The first female-edge attachment member 122 is positioned a sixth distance inboard from the second female-edge attachment member 124.

In preferred embodiments, the attachment members include symmetric members that are similar or equivalent in construction to male edge-connectors 132. Accordingly, each of the male-edge attachment members 142/144/146 may be substantially parallel to each of the other male-edge attachment members 142/144/146 and to each of the male edges 130 and male connectors 132. Likewise, each of the female-edge attachment members 122/124/126 may be substantially parallel to each of the other female-edge attachment members 122/124/126 and to each of the female edges 110. The attachment members may be fasteners and or couplers. In the preferred embodiment, the attachment members are male fasteners or couplers. In alternative embodiments, the attachment members are female fasteners or couplers. In some embodiments, panel 100 includes couplers or clips 118 positioned near at least one of the four corners of panel 100. Other positions for clips 118 are possible. For instance, a clip may be included in the space between male/female edge-notches 136/116 and attachment members 126/142.

Figure 1B:
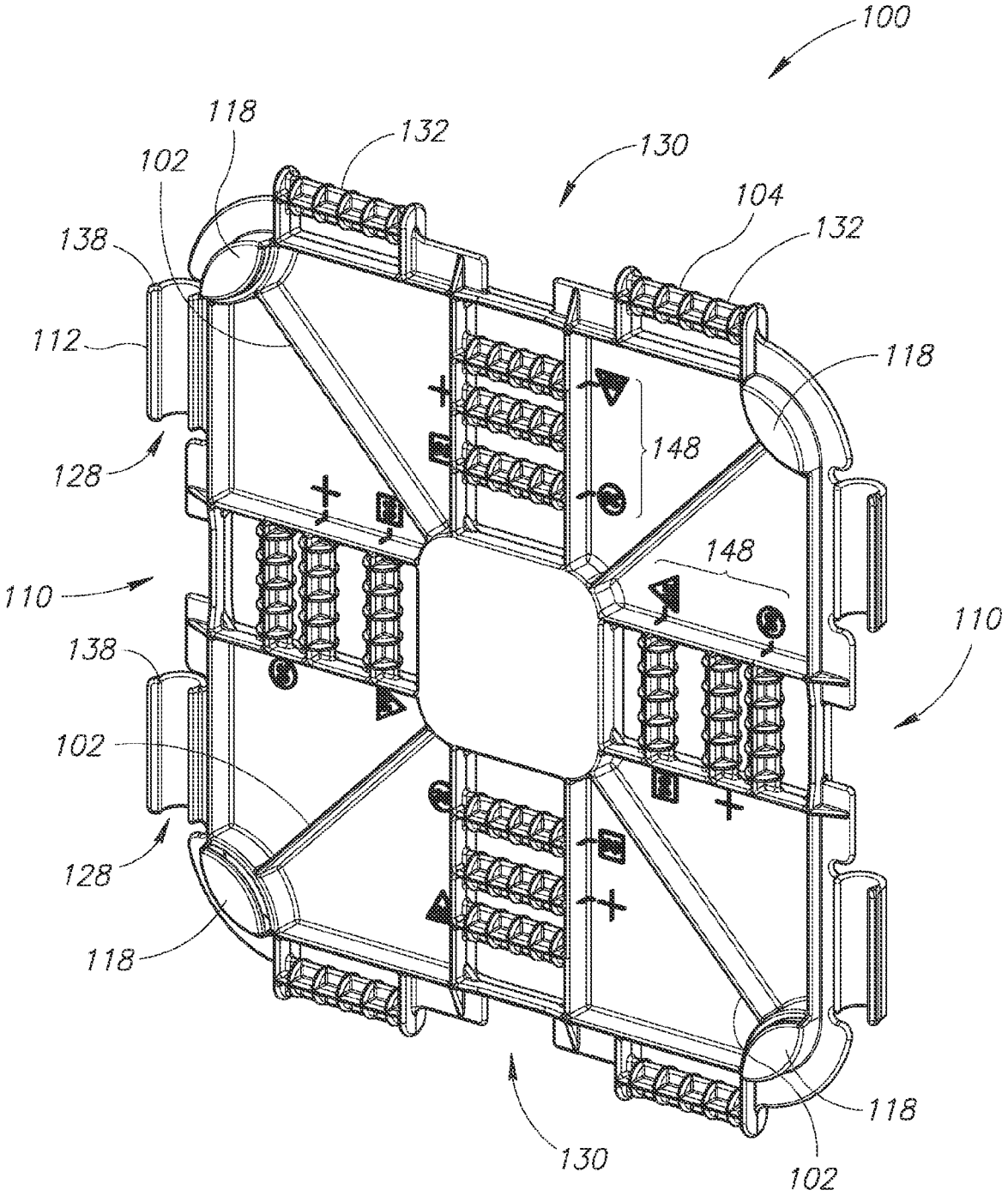
FIG. 1B includes an off-axis view of the backside of the panel of FIG. 1A.

FIG. 1B includes an off-axis view of the backside of the panel 100 of FIG. 1A. The off-axis view of the backside of panel 100 shows many of the same features as the front side view of FIG. 1A, such as the male edges 130 and the female edges 110, as well as the corresponding male connectors 132 and the female connectors 112. Each male connector 132 and each attachment member includes a plurality of connector reinforcing ribs 104. The connector reinforcing ribs 104 decrease the amount of material required to construct panel 100 while providing a greater strength and integrity to the male connectors 132 and attachment members.

As shown in FIG. 1B, each female connector 112 includes a receptacle, trench, clip, or groove 128. In the illustrated embodiment, the female connector trench 128 is oriented toward the backside of panel 100. In other embodiments, the trench 128 is oriented toward the front side of panel 100. Each female connector 112 also includes a trench lip 138 that is positioned on at least one of the trench's 128 edges, sides, or surfaces. In a preferred embodiment, the trench lip 138 is positioned along an outer edge of the connector trench 128. As will be discussed below, each of the female connector trenches 128 is configured and arranged to receive one of the male connectors on another panel that is similar to panel 100. The combination of the trench 128 and the trench lip 138 may form a clip included in the female connectors 112. The female connector clip provides a snapping and/or tactile feedback when any of the male connectors 132 or attachment members are received by, interlocked with, or otherwise coupled to the female connectors 112.

By receiving the male connector, the female connector 112 and the male connector of the other panel are coupled and/or interlocked. Such an interlocking or snapping of the female connector 112 and the male connector of the other panel couples the female edge to the male edge. Accordingly, male/female connectors 132/112 may be male/female edge-connectors. By coupling the male and female edges, panel 100 is coupled to the other panel.

In a preferred embodiment, the trench lip 138 secures and/or stabilizes the coupling of the female edge-connector 112 and the male edge-connector of the other panel. As noted above, the trench lip 138 enables the snapping and/or interlocking into and out of place of the male edge-connector and the female edge-connector. In a preferred embodiment, the trench lip 138 and/or clip provides tactile feedback of the interlocking of the male edge-connector with the female edge-connector.

Figure 10A:
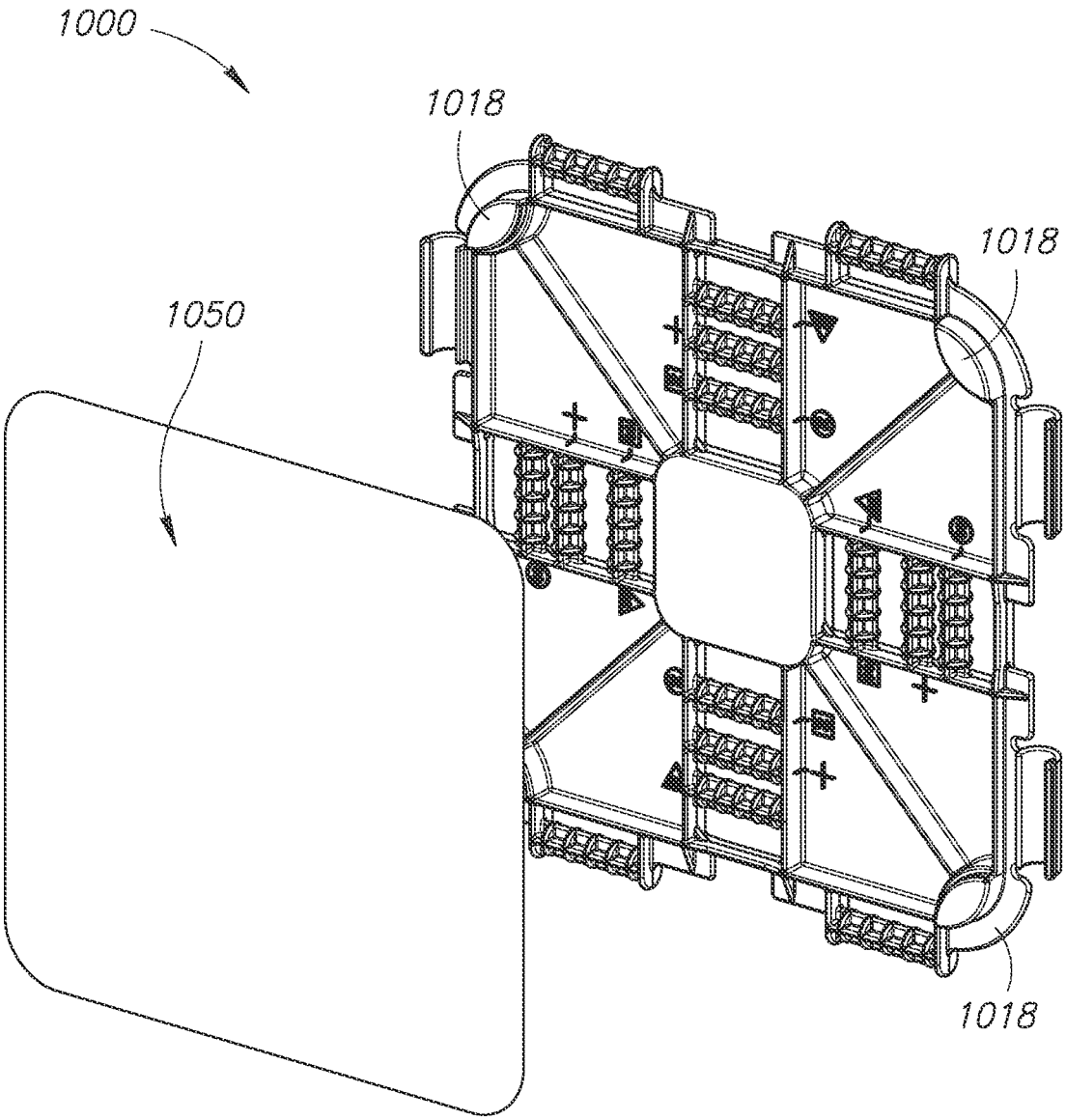
FIGS. 10A-10B show the attachment of a planar member to a panel.
Figure 10B:
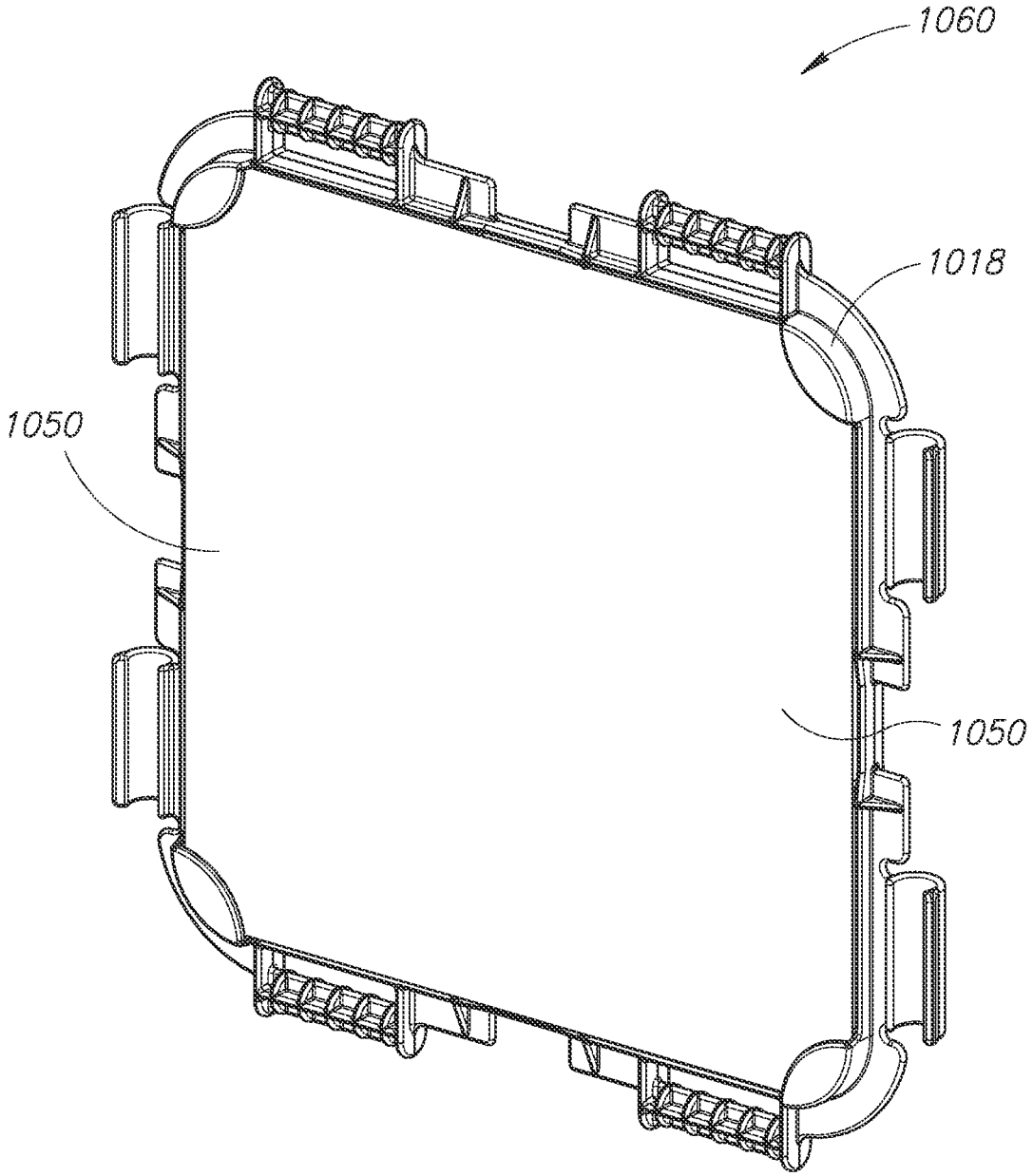

Also shown in FIG. 1B, the backside of panel 100 includes a plurality of panel reinforcing ribs 102 to reinforce the structural integrity of panel 100. The reinforcing ribs 102 may be transverse to the edges 110/130 of panel 130. In the embodiment shown, the panel reinforcing ribs 102 run along a hypotenuse of each of the quadrants 108. However, it should be understood that other configurations of panel reinforcing ribs 102 are possible. The reinforcing ribs 102 provide structural integrity to panel 100 and the rigid structures that are formed by panel 100. The reinforcing ribs 102 also provide support when a planar member, such as planar member 1050 of FIGS. 10A-10B are coupled to the backside of panel 100. For instance, the reinforcing ribs 102 provide support when a user draws on, paints, or otherwise puts pressure on the planar member during a customization or decoration of the planar member. The couplers or clips 118 positioned on the corners of panel 100 are shown oriented towards the backside of panel 100. In other embodiments, clips 118 may be included on both the front side and backside, or on only one of either of the front and backsides of panel 100.

The edges of panel 100 may be of any linear dimension, as long as panel 100 is a substantially square panel, i.e. the female edges 110 are substantially equivalent in length to the male edges 130. In at least one preferred embodiment, the linear dimensions of the edges are approximately 8.5 inches. The thickness of the panel may be approximately 0.4 inches deep. Although panel 100 may be constructed from any material, preferred embodiments are constructed from plastic, such as injection-molded plastic. The thickness of the plastic should be thick enough to provide the required rigidity. A preferred thickness of the molded plastic is approximately 0.065 inches. The plastic may be a rigid and/or non-toxic plastic. It should be understood that if more practical and/or sturdy structures are desired, the physical dimensions and materials used to construct panel 100 may be varied to meet the required structural integrity.

Also shown in FIG. 1B, at least some of the male/female-edge attachment members are labeled and/or tagged with various markings 148. The functioning of these markings 148 is explained below. In a preferred embodiment, panel 100 is symmetric about the axis that bisects each of the male edges 130. Furthermore, panel 100 is also symmetric about the axis that bisects each of the female edges 110.

Figure 2A:
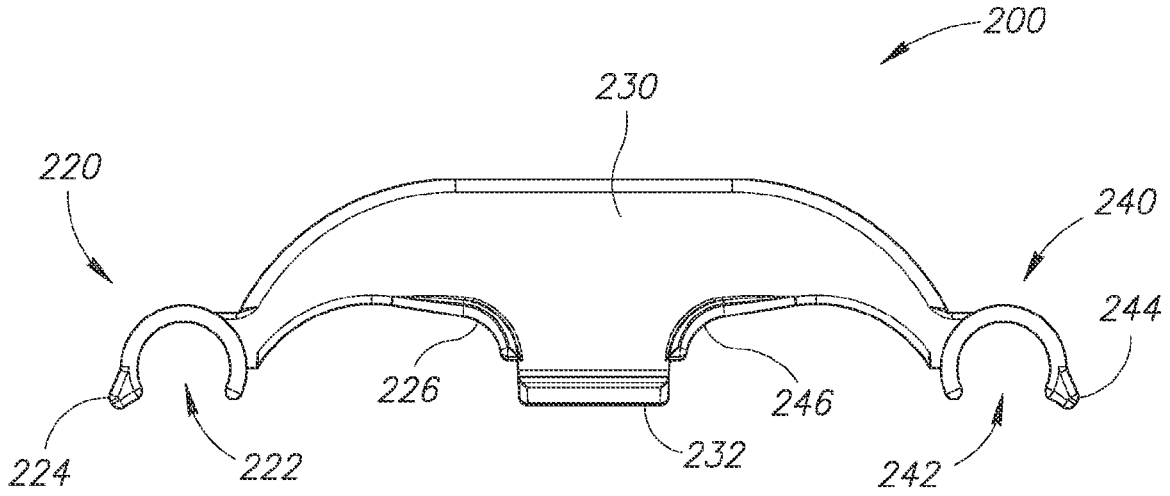
FIG. 2A shows a fixing member that is consistent with various embodiments disclosed herein.

FIG. 2A shows a fixing member 200 that is consistent with various embodiments disclosed herein. Fixing member 200 may include connector members, locking devices, clips, and the like. In at least one embodiment, fixing member 200 may include a straight connection clip. Fixing member 200 includes a body 230. The first longitudinal end of fixing member 200 includes a first female connector 220. The second longitudinal end of fixing member 200 includes a second female connector 240. The female connectors included on fixing member may be female fixing member connectors. In a preferred embodiment, the female fixing member connectors 220/240 are similar to the female edge-connectors 112 of panel 100. As such, the first female connector 220 includes a first trench 222 and a first lip 224. The second female connector 240 includes a second trench 242 and a second lip 244. The combination of the trench 222/242 and the lips 224/244 may form first and second clips. As explained below, each of the female fixing member female connectors 220/240 are configured and arranged to interlock or couple with any of the male/female-edge attachment members of panel 100. Accordingly, the first and second female connectors 220/240 may providing snapping or tactile feedback.

In alternative embodiments, wherein the male/female-edge attachment members of panel 100 are female connectors, the fixing member connectors 220/240 of fixing member 200 may be male connectors. In these embodiments, connectors 220/240 may be similar to male connectors 132 of panel 100 of FIGS. 1A-1B.

Fixing member 200 is a rigid member. Although fixing member 200 may be constructed from any suitable material, in some embodiments, fixing member 200 is constructed from a similar plastic to the plastic used in the construction of panel 100. The thickness of the plastic may be similar to the thickness of the plastic of panel 100. The length, width, and height of the fixing member 200 are dependent upon the dimensions of panel 100. However, in a preferred embodiment, the length of fixing member 200 is approximately 3.8 inches long (from first lip 224 to second lip 244). The width of the body 230 is approximately 1.25 inches and the height of the body is approximately 1 inch tall.

Figure 2B:
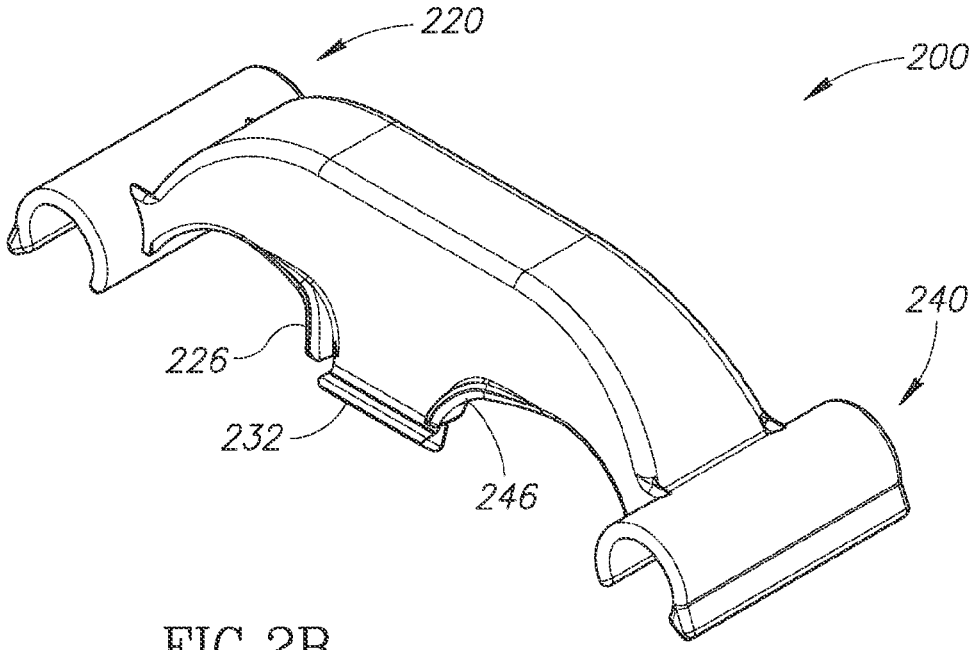
FIG. 2B provides an off-axis view of the fixing member of FIG. 2A.

FIG. 2B provides an off-axis view of the fixing member 200 of FIG. 2A. Fixing member 200 includes a fixing member stabilizing-lip 232 or straight clip. Fixing member stabilizing-lip 232 may be a reinforcing lip. Fixing member 200 also includes a first upper stabilizing lip 226 and a second upper stabilizing lip 246. Fixing member 200 is symmetric about both a longitudinal axis running the length of the fixing member 200 and symmetric about a lateral axis orthogonal to the longitudinal axis.

FIGS. 3A-3D show the formation of a portion of a rigid three-dimensional structure that includes two panels that are each similar to panel 100 of FIGS. 1A-1B. The panels are coupled and fixed in a collinear configuration and at a relative angle of 180° by a fixing member that is similar to fixing member 200 of FIGS. 2A-2B. FIGS. 5-9 show that other fixed or locked relative angles are possible by a similar construction process. To fix or lock the relative angle between the two panels, the fixing member is coupled to either the back or the front side of each of the two panels. As shown in FIGS. 5-9, the fixing member is affixed to the backsides of the panels. However, for each configuration, the fixing member may be affixed to the front side of the panels as well.

Figure 3A:
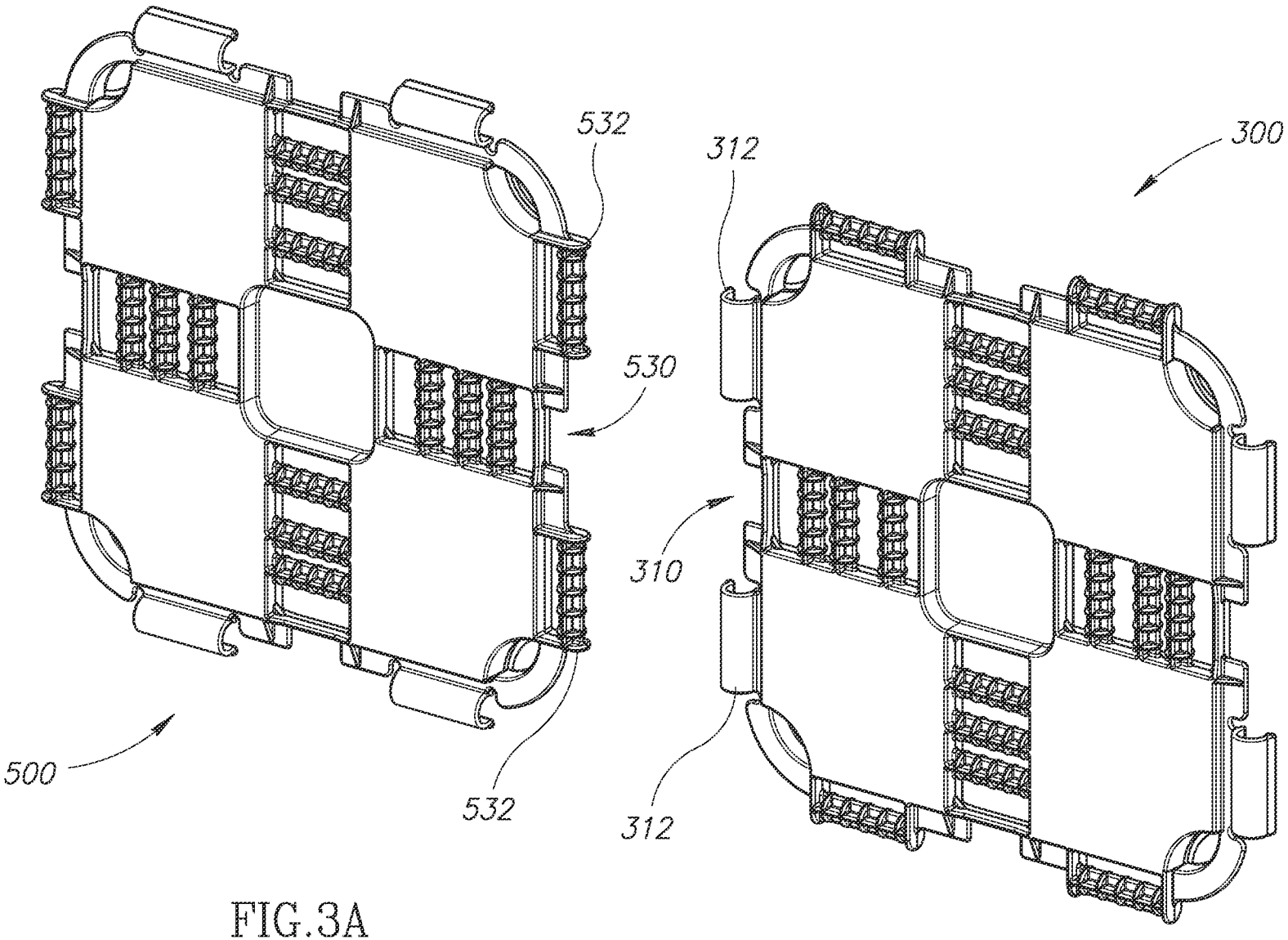
FIGS. 3A-3D show the formation of a portion of a rigid three-dimensional structure that includes two panels that are each similar to the panel of FIGS. 1A-1B.

FIG. 3A shows two panels: a first panel 300 and a second panel 500. Each of the two panels 300/500 is similar to panel 100 of FIGS. 1A-1B. A female edge 310 of first panel 300 is aligned with a corresponding male edge 530 of the second panel 500. As shown, by aligning the female edge 310 with the male edge 530, two female edge-connectors 312 of panel 300 are aligned with the two corresponding male edge-connectors 532 of panel 500.

Figure 3B:
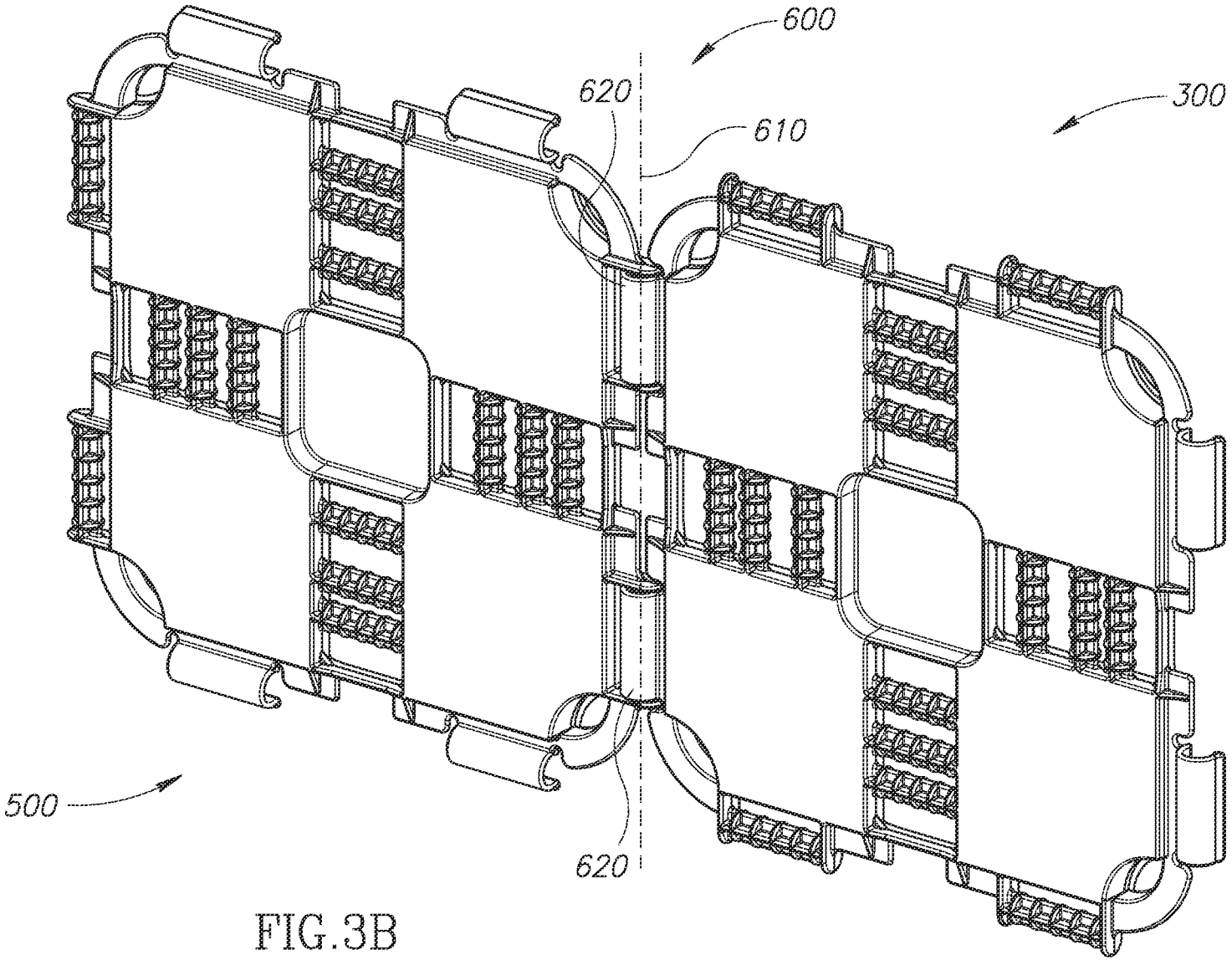

In FIG. 3B, three-dimensional structure 600 is formed when the first panel 300 is coupled to the second panel 500 by the interconnecting, mating, and/or coupling of the female edge-connectors 312 with the corresponding and aligned male edge-connectors 532. When interconnected and/or coupled, the female edge-connectors 312 and the male edge-connectors 532 form a rotational hinge structure 620 positioned between the coupled first panel 300 and the second panel 500.

Figure 3C:
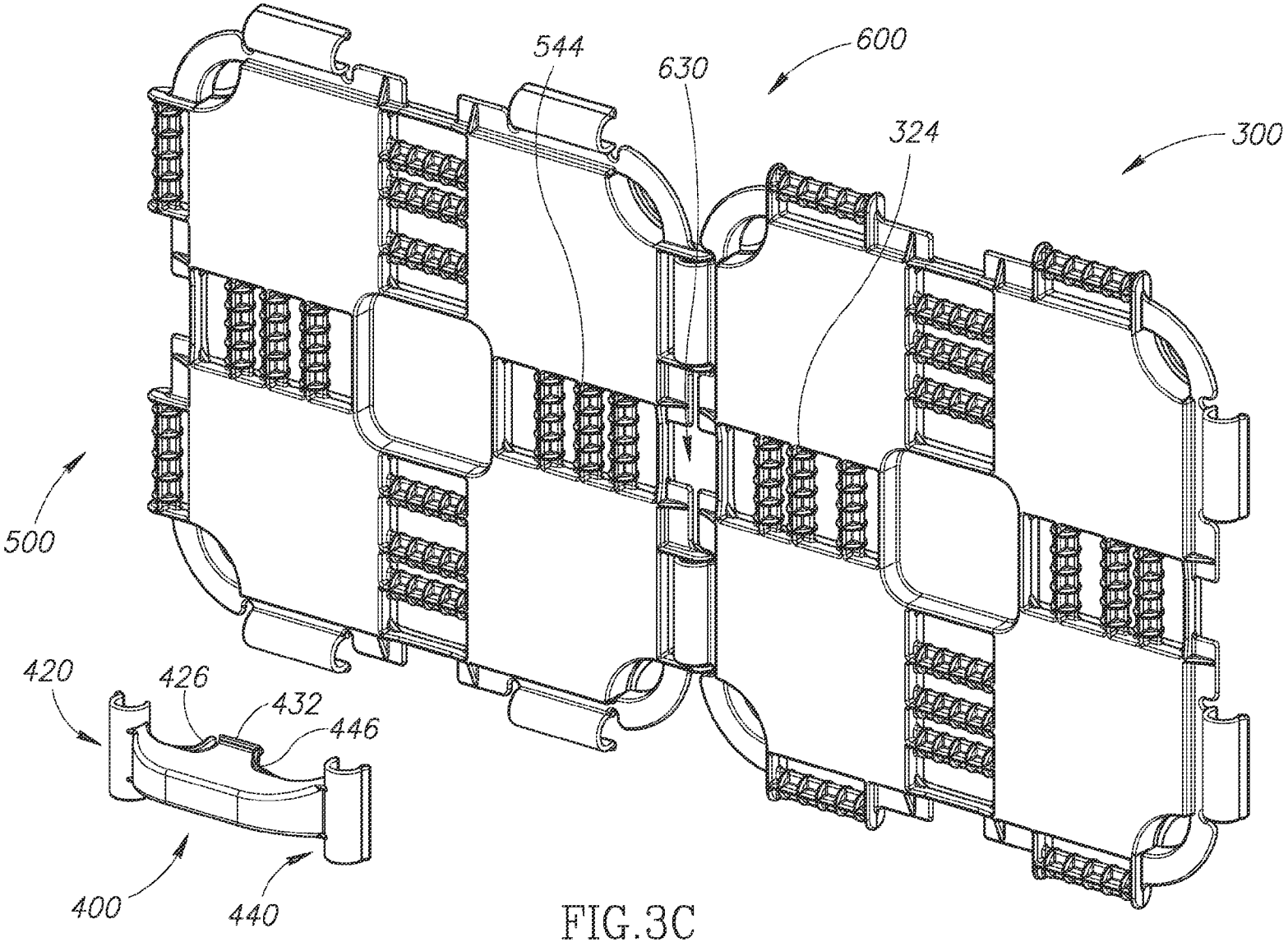
Figure 3D:
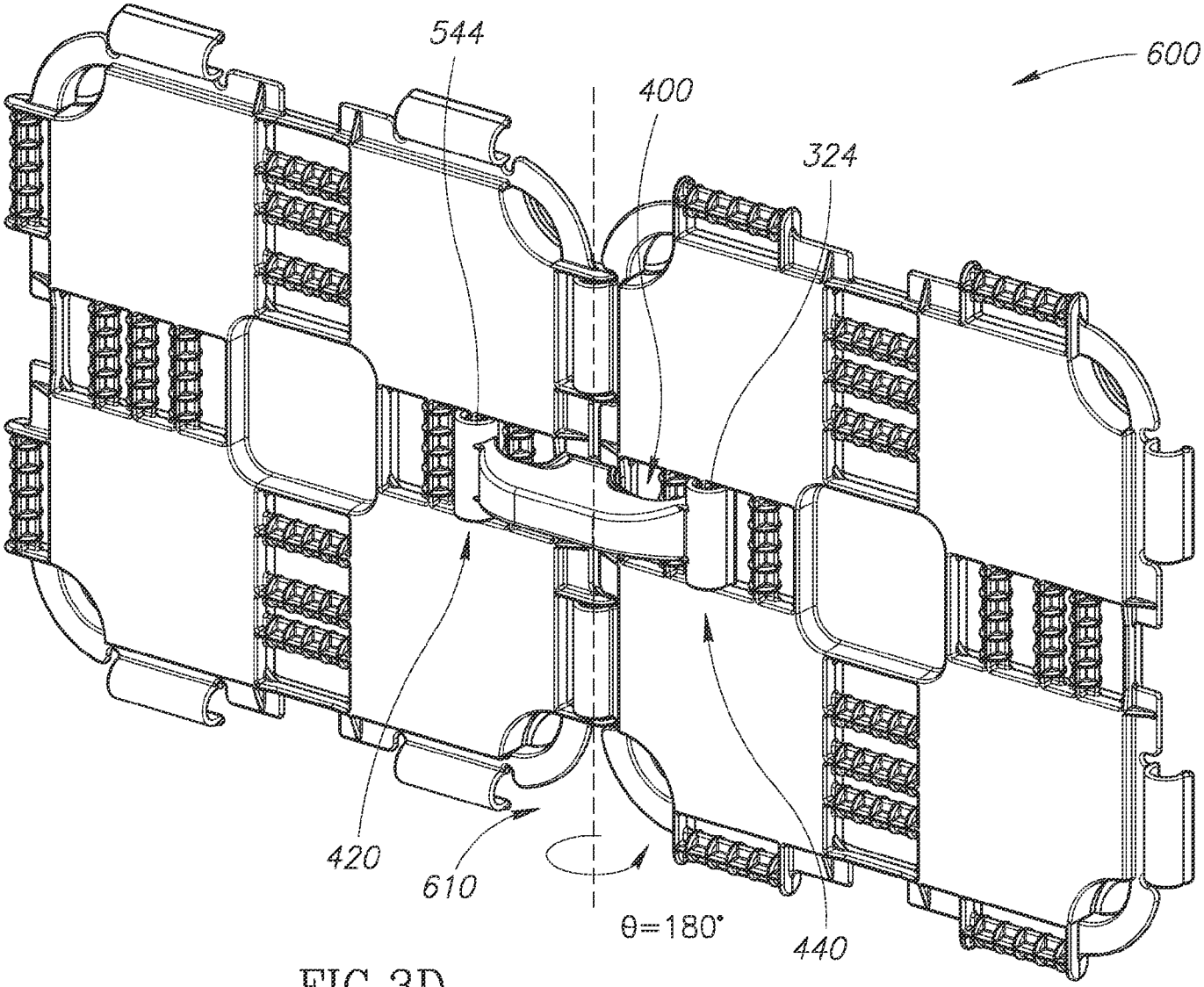

Once coupled by the female edge-connectors 312 and the male edge-connectors 532, the hinge 620 enables the first panel 300 to freely rotate relative to the second panel 500 (and vice versa) about the rotation axis 610 defined by the hinge 620. In a preferred embodiment, the relative rotation between the first panel 300 and the second panel 500 define a relative angle, θ, between the two panels. As shown in FIGS. 3B-3D. θ is substantially equivalent to 180°. Thus, panels 300/500 are collinear panels. In a preferred embodiment, the physical constraints associated with the formed hinge 620 constrain θ between approximately 550 and 305°. Accordingly, θ may vary by approximately 2500. As shown in FIG. 3B, first panel 300 and second panel 500 may be connected so that the front side of each panel is oriented to face the same direction. However, first panel 300 and second panel 500 may be coupled so that the front side of the first panel 300 may face an opposing direction than that of the front side of the second panel 300.

FIG. 3C shows the alignment of a fixing member 400 with the three-dimension structure 600. The fixing member 400 may be similar to fixing member 200 of FIGS. 2A-2B. As such, fixing member 400 includes a first female connector 420 and a second female connector 440. The first and second female connectors 420/440 may be female fixing female connectors similar to female connectors 220/240 of FIGS. 2A-2B. Fixing member 400 also includes fixing member stabilizing-lip 432, which may be similar to lip 232 of FIGS. 2A-2B. Fixing member 400 including first and second upper stabilizing-lips 426/446, which may be similar to the corresponding upper stabilizing-lips 226/246 of FIGS. 2A-2B.

The edge-tabs and edge notches associated with the male edge 530 and female edge 310 form an interface aperture 630 centered on rotational axis 610. As noted above, each of the female connectors 420/440 of fixing member 400 are configured and arranged to couple and/or interlock with any of the attachment members included in each of the first panel 300 and the second panel 500. Because the fixing member 400 is a rigid member, when one of the female connectors 420/440 is coupled to both an attachment member of first panel 300 and another attachment member of second panel 500, the relative angle between the two panels, θ, is fixed. The relative angle is dependent upon the length of the fixing member 400 and the positions of each of the attachment members that the fixing member 400 is coupled to. In a preferred embodiment, the length of the rigid fixing member 400 is such that when first female fixing member connector 420 is coupled to the second male-edge attachment member 544 of second panel 500 and the second female fixing member connector 440 is coupled to the second female-edge attachment member 324 of the first panel 300, θ is fixed at approximately 180°.

FIG. 3D shows fixing member 400 coupled to three-dimensional structure 600, fixing θ at 180° and providing rigidity to the formed structure 600. Specifically, the first female connector 420 is interconnected to the second male-edge attachment member 544 and the second female connector 440 is coupled to the second female-edge attachment member 324. Because of the lateral symmetry of fixing member 400, the orientate on of fixing member 400 may be reversed such that the first female connector 420 is coupled to the second panel 500 and the second female connector 440 is coupled to the first panel 300. When the female connectors 420/440 couple, mate, interlock, or snap onto the attachment members 324/544, the user is provided with tactile feedback that is at least partially enabled by the lip of the female connectors 420/440. In a preferred embodiment, the female connectors 420/440 of fixing member 400 are configured and arranged to couple to, interlock with, or otherwise snap onto any of the male-edge connectors of the panels 300/500. As mentioned above, in alternative embodiments, connectors 420/440 are male connectors and the attachment members of the panels 300/500 include corresponding female connectors.

Figure 4:
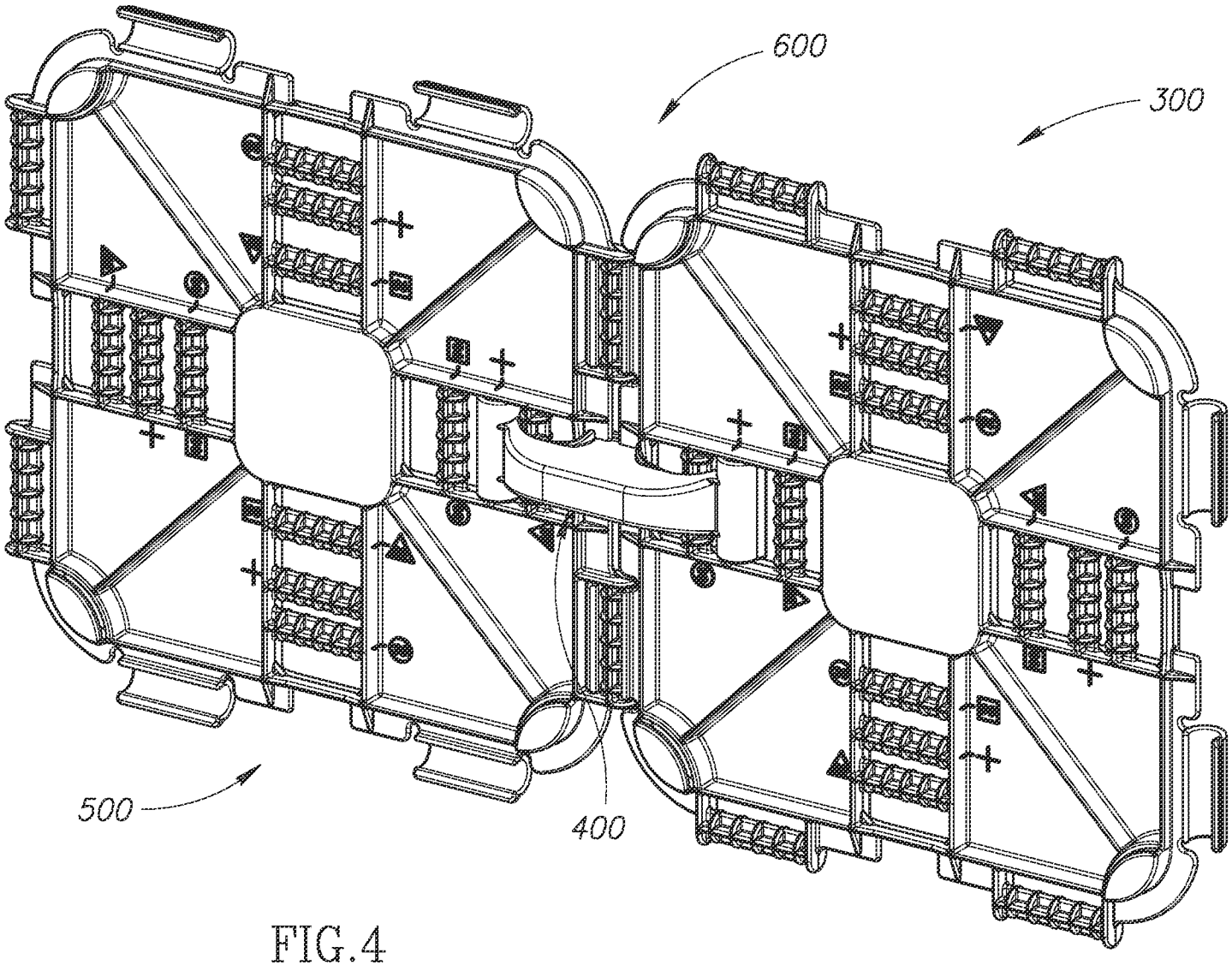
FIG. 4 illustrates the rigid three-dimension structure of FIGS. 3A-3D, where the fixing member is affixed to the backsides of the two panels.

Furthermore, fixing member stabilizing-lip 432 is received by and snaps into interface aperture 630. When stabilizing-lip 432 is received by and couples to the interface aperture 630, the rigidity of structure 600 is increased. Furthermore, the first and second upper stabilizing lips 426/446 act as a brace against the corresponding male/female edge-tabs to provide even greater stability and prevent a rotation along the hinge. This snapping provides tactile feedback to the user. Note that fixing member 400 is positioned of the front side of each of the first panel 300 and the second panel 500. However, the symmetry between the front and backsides of the panels 300/500 as well as the symmetry of each of the attachment members enables the coupling of the fixing member 400 to either the front or backsides of the panels 300/500. For instance, FIG. 4 illustrates the rigid three-dimension structure 600 of FIGS. 3A-3D, where the fixing member 400 is affixed to the backsides of the two panels 300/500.

Figure 5:
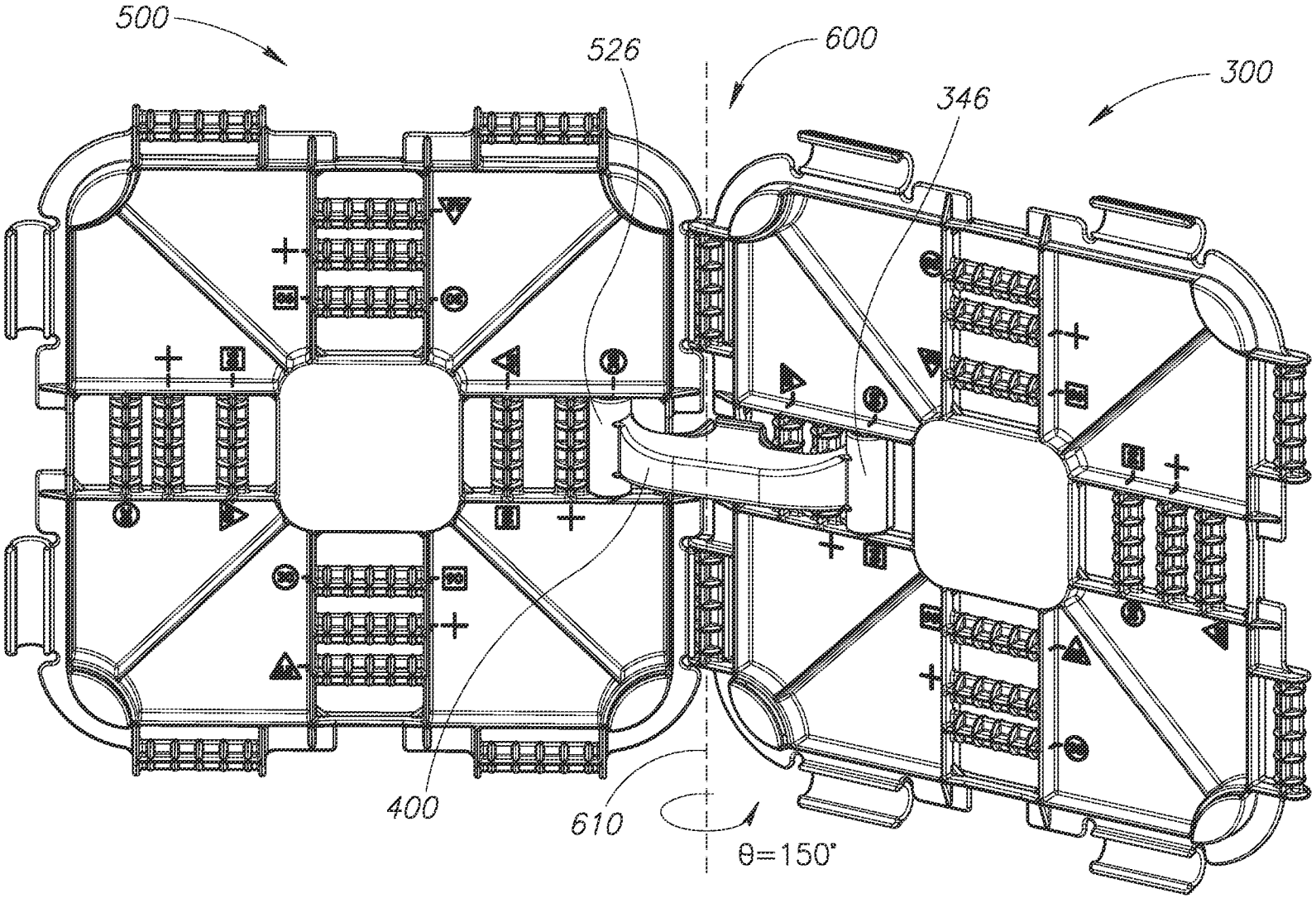
FIG. 5 illustrates a portion of a three-dimensional structure formed by two panels fixed at a relative angle of 150°.

The fixed relative angle, θ, varies with the choice of the attachment members that the fixing member 400 is coupled to on each of the panels 300/500. Accordingly, the coupling configuration that fixing member 400 is coupled to panels 300/400 determines the relative angle, θ. In the preferred embodiment shown, up to seven discreet values for θ may be chosen: 35°, 90°, 107°, 115°, 135°, 150°, and 180°. Thus, up to seven configurations for fixing member 400 are possible. FIG. 5 illustrates a portion of a three-dimensional structure 600 formed by two panels 300/500 fixed at a relative angle, θ, of 150°. Fixing member 400 is coupled to both the third male-edge attachment member 346 of panel 300 and the third female-edge attachment member 526 of panel 500. As shown in FIGS. 4-9, the markings 148 on the backside on panel 100 (as shown in FIG. 1B) provide an indication of the locked relative angle. For instance, the particular markings associated with particular attachment members provide a user an indication as to what relative angle between the two panels 300/500 will be fixed or locked when the user attaches or couples the fixing member 400 to the particular attachment members that are associated with the particular markings.

Figure 6:
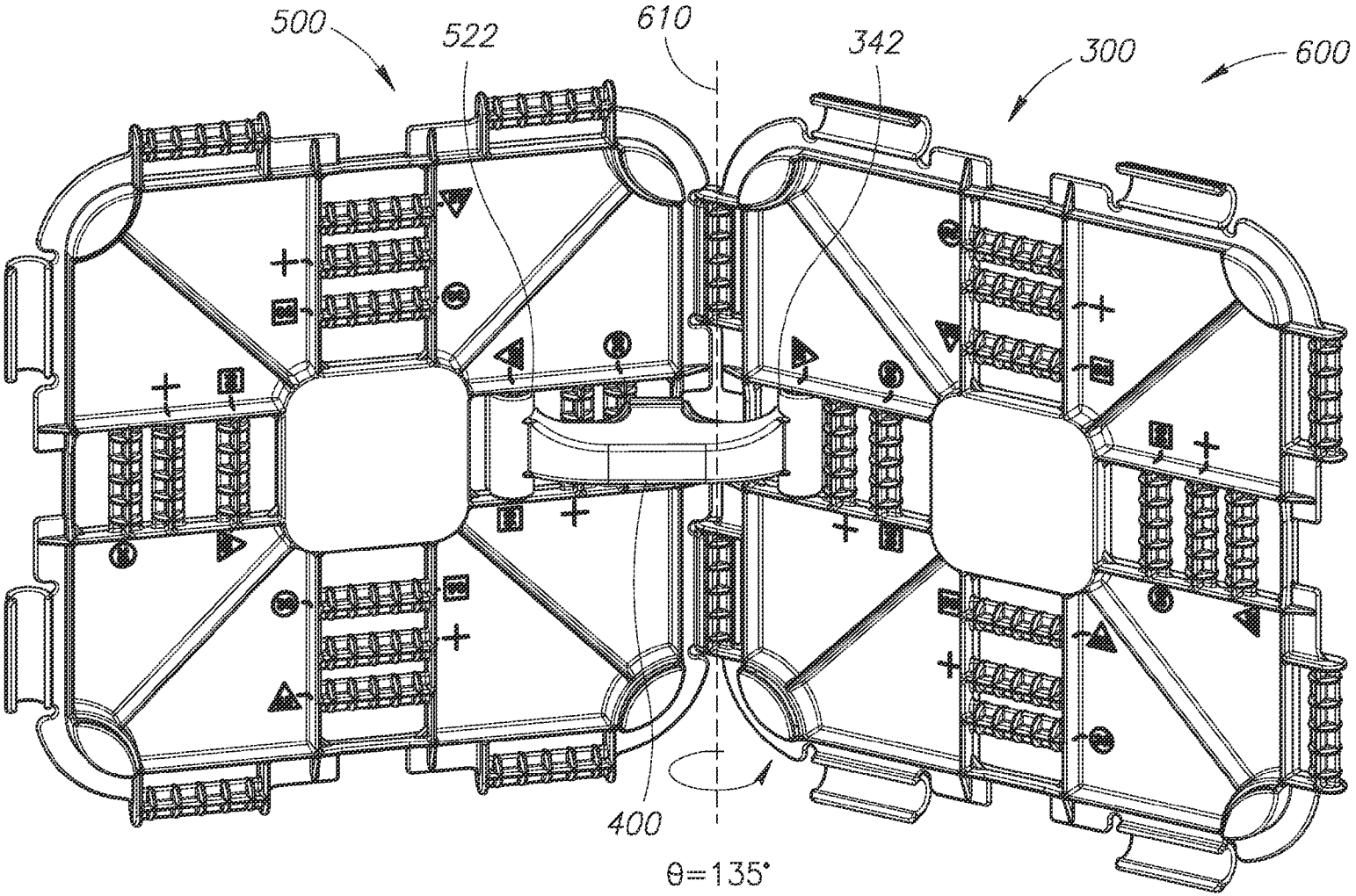
FIG. 6 illustrates a portion of a three-dimensional structure formed by two panels fixed at a relative angle of 135°.

FIG. 6 illustrates a portion of a three-dimensional structure 600 formed by two panels 300/500 fixed at a relative angle, θ, of 135°. Fixing member 400 is coupled to both the first male-edge attachment member 342 of panel 300 and the first female-edge attachment member 522 of panel 500.

Figure 7:
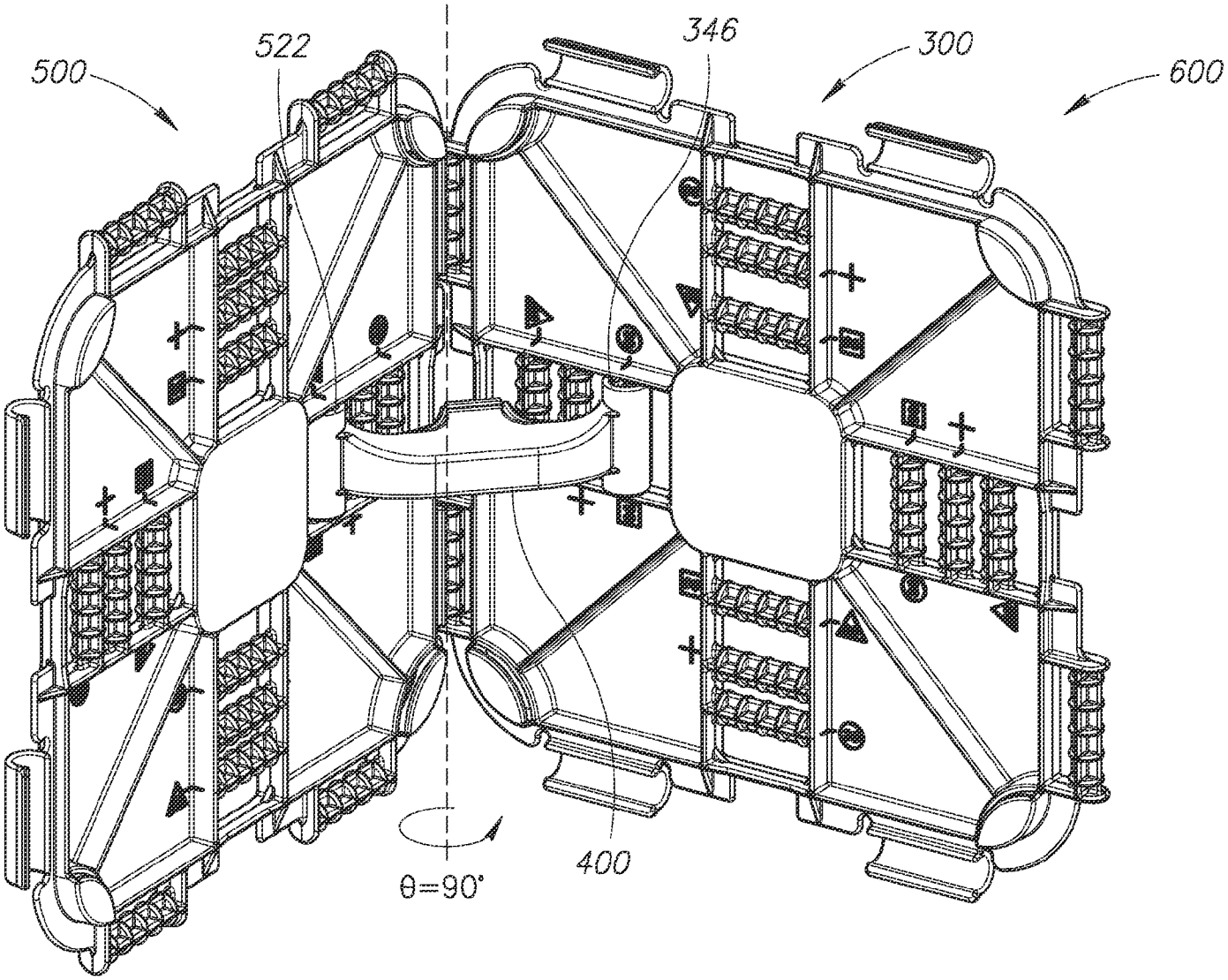
FIG. 7 illustrates a portion of a three-dimensional structure formed by two panels fixed at a relative angle of 90°.

FIG. 7 illustrates a portion of a three-dimensional structure 600 formed by two panels 300/500 fixed at a relative angle, θ, of 90°. Fixing member 400 is coupled to both the third male-edge attachment member 346 of panel 300 and the first female-edge attachment member 522 of panel 500.

Figure 8:
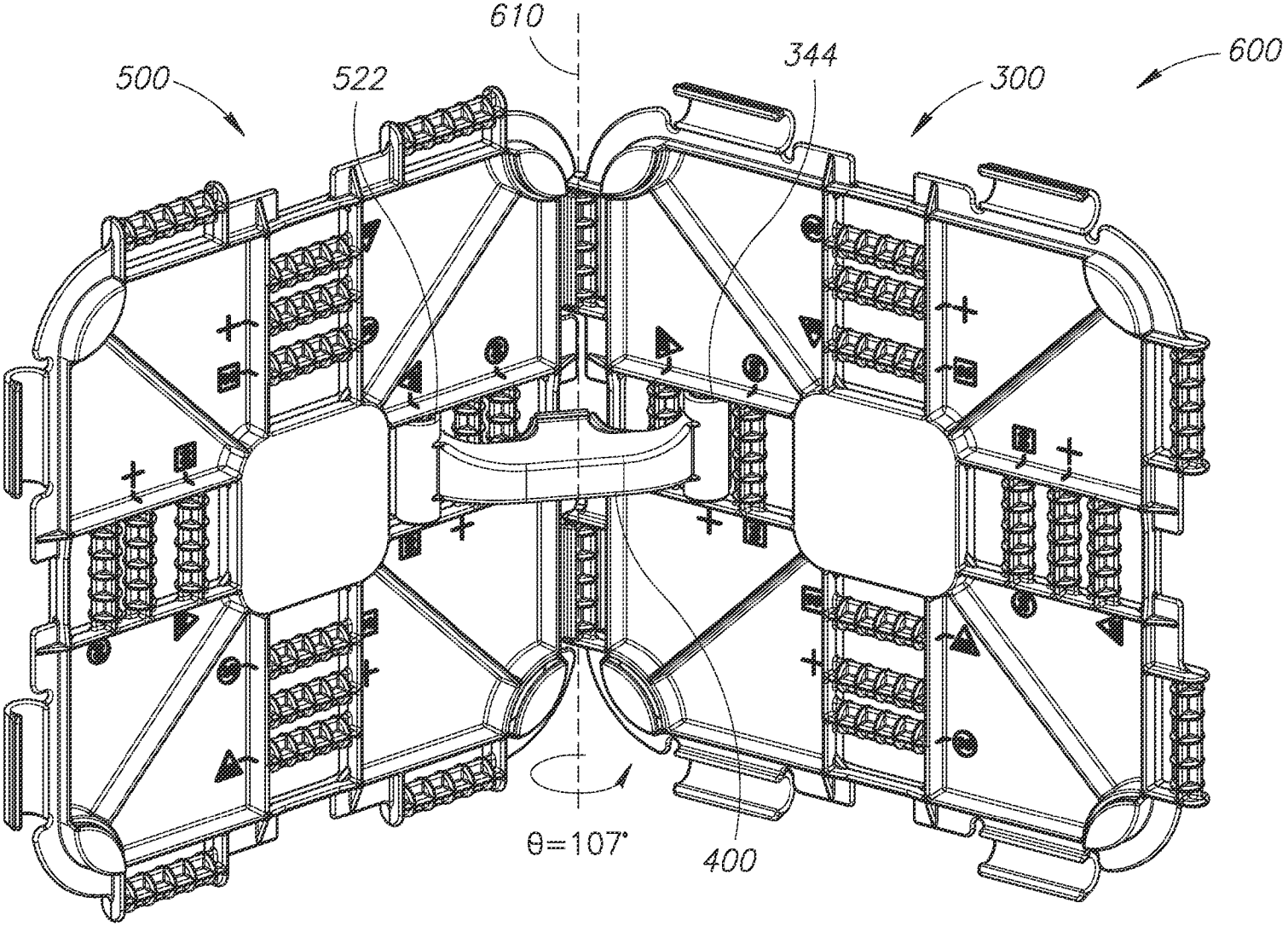
FIG. 8 illustrates a portion of a three-dimensional structure formed by two panels fixed at a relative angle of 107°.

FIG. 8 illustrates a portion of a three-dimensional structure 600 formed by two panels 300/500 fixed at a relative angle, θ, of 107°. Fixing member 400 is coupled to both the second male-edge attachment member 344 of panel 300 and the first female-edge attachment member 522 of panel 500.

Figure 9:
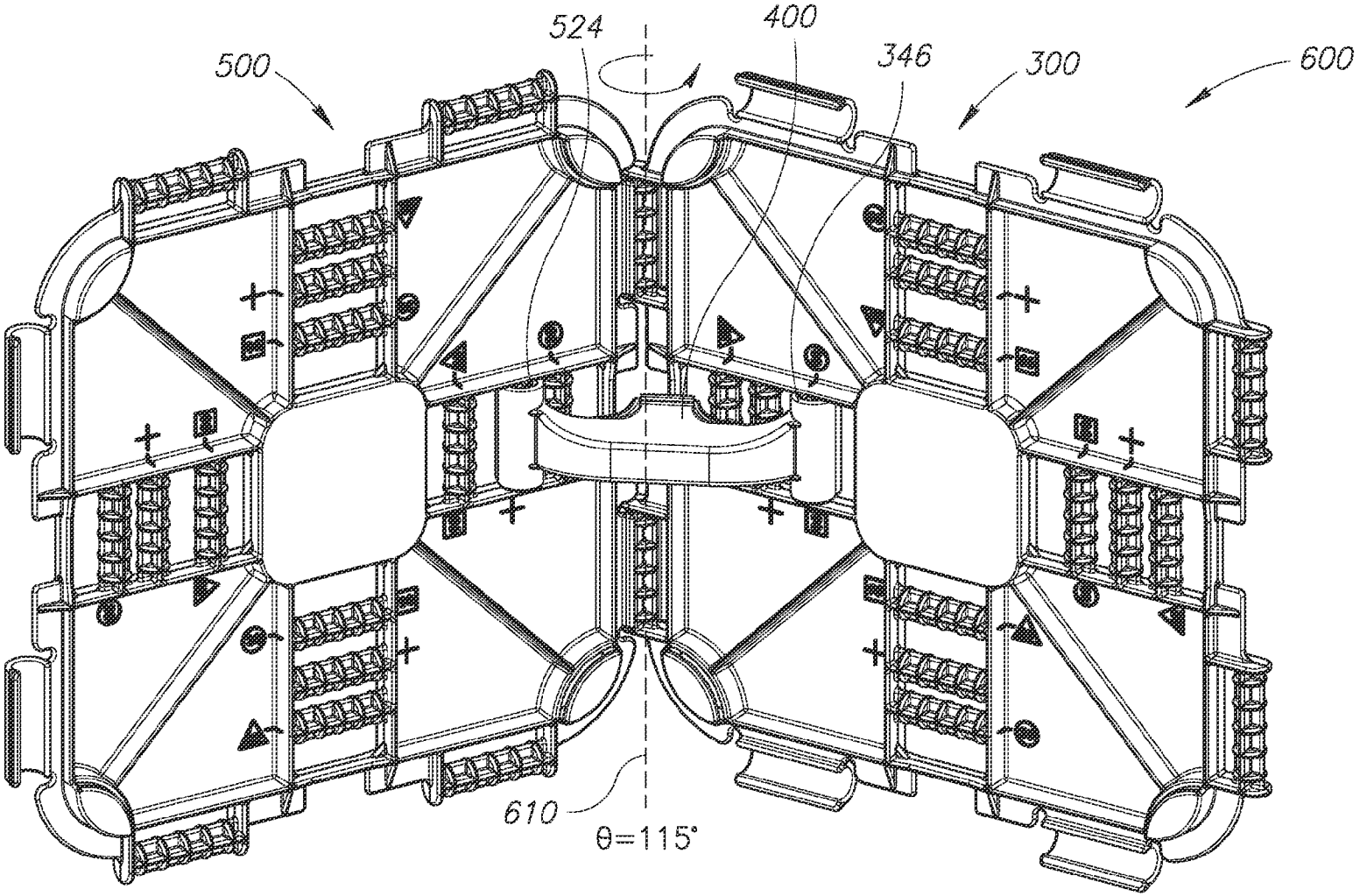
FIG. 9 illustrates a portion of a three-dimensional structure formed by two panels fixed at a relative angle of 115°.

FIG. 9 illustrates a portion of a three-dimensional structure 600 formed by two panels 300/500 fixed at a relative angle, θ, of 115°. Fixing member 400 is coupled to both the third male-edge attachment member 346 of panel 300 and the second female-edge attachment member 524 of panel 500.

FIGS. 10A-10B show the attachment of a planar member 1050 to the backside of a panel 1000. Panel 1000 may include similar features to panel 100 of FIGS. 1A-1B. Accordingly, panel 1000 includes clips 1018 on the backside of panel 1000 that enable the attachment or coupling of the planar member 1050 to panel 1000. In other embodiments, the clips may be on the front side of panel 1000. The clips may be on both sides of panel 1000 in still other embodiments.

Planar member 1050 may include a graphic element or component. When planar member 1050 is attached to panel 1000, as shown in FIG. 10B, panel 1000 is decorated with the graphical element included in planar member 1050. Planar member 1050 may be constructed from cardboard stock or other planar, lightweight materials. Planar member 1050 may include a supplied graphic, such as a brick, stone, wood paneling, or any other graphic. The graphic may be a symmetric graphic. In at least one embodiment, at least a portion of the planar member 1050 includes a whiteboard or chalkboard element so that a user may customize the graphic that decorates panel 1000. A supplied graphic may be included on one side (front side) of the planar member 1050 and a whiteboard/chalkboard element may be included on the other side (backside) of planar member 1050. In such embodiments, a user may choose to display the front side or the backside of planar member 1050 when coupling it to panel 1000. A plurality of graphic planar members 1050 may be included in any of the systems, kits, or assemblies discussed herein so that a user may decorates the structure that is built from the system, kit, or the like.

Figure 11:
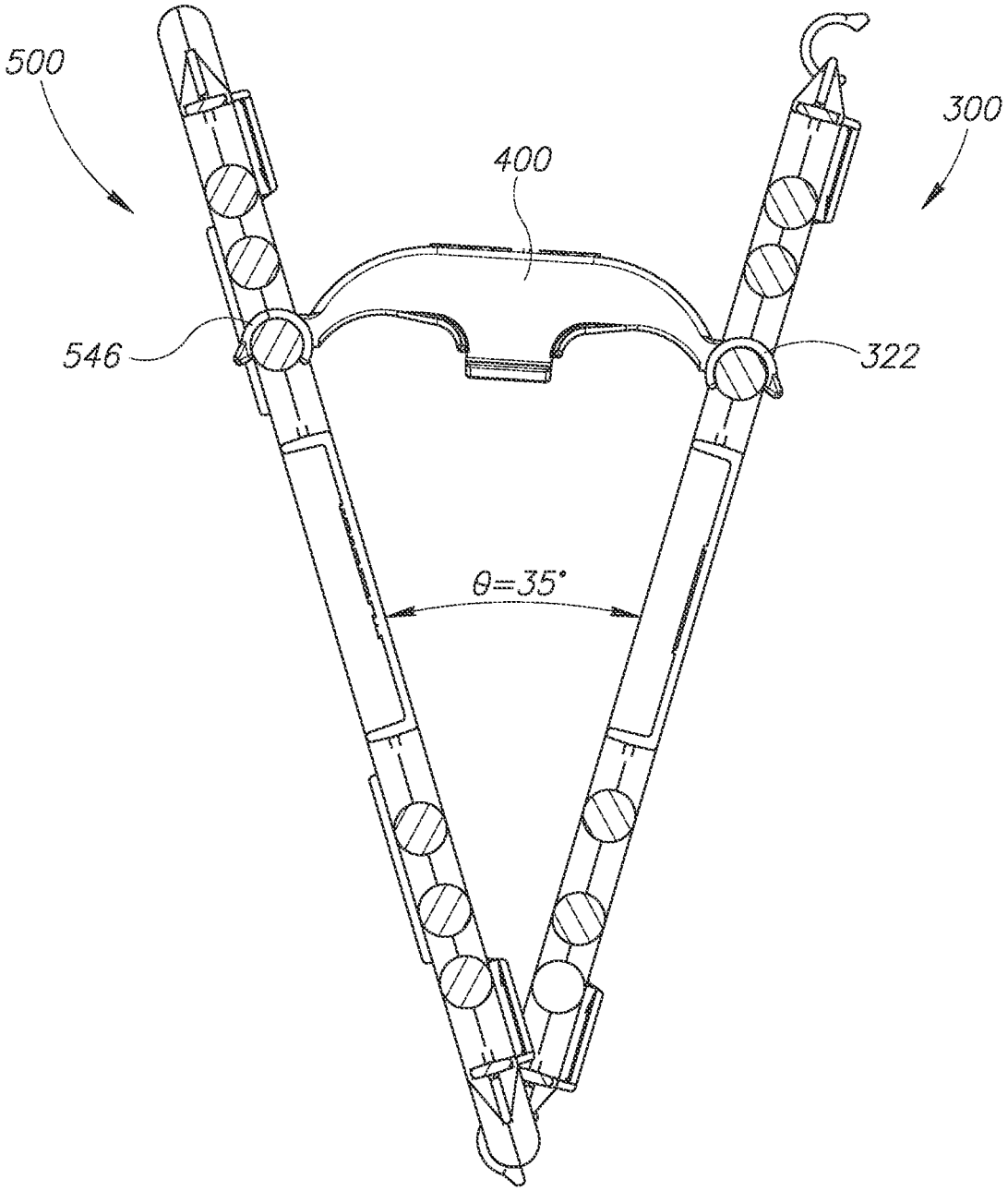
FIG. 11 illustrates a portion of a three-dimensional structure formed by two panels fixed at a relative angle of 35°.

FIG. 11 illustrates a portion of a three-dimensional structure formed by two panels 300/500 fixed at a relative angle, θ, of 35°. Note the placement of fixing member 400 for the smaller relative angle. Fixing member 400 is coupled to both the third male-edge attachment member 546 of panel 500 and the first female-edge attachment member 322 of panel 300. However, the first female-edge attachment member 322 is associated with the female edge of panel 300 that is not coupled to panel 500.

FIG. 12 shows the coupling of three panels to form a three-dimensional structure. Note that two of the three panels are coupled in a manner that is similar to panels 300 and 500 of FIGS. 3A-3D and form a relative angle, $\theta_1$=180°. A first fixing member, such as fixing member 400 of FIGS. 3A-3D is coupled to the front side of each of the panels. This first fixing member is shown in FIG. 12 as being underneath the panels. The third panel is approximately orthogonal to the first two panels such that $\theta_2$=90°. The third panel is secured in place by at least one additional fixing member. The additional fixing member is coupled to the third panel and to one of the two panels that form an angle of $\theta_1$=180°, as shown in FIG. 12. In some embodiments, two additional fixing members are employed, so that one of the two additional fixing members is affixed to each of the two panels that are arranged in a plane, similar to the fixing member orientation of FIG. 13A.

Figure 13A:
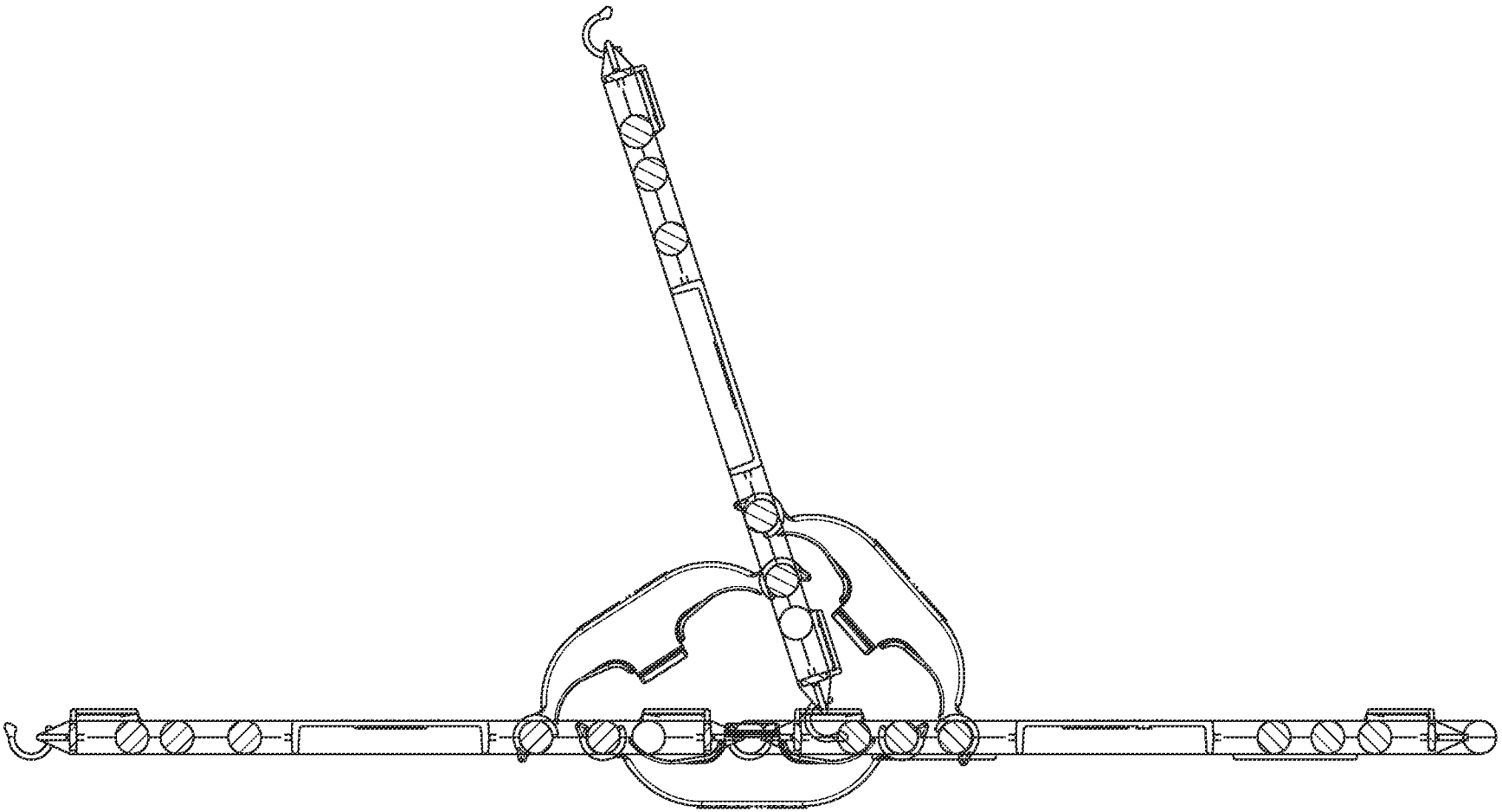
FIGS. 13A-13B illustrate other three-dimensional structures formed by three panels.
Figure 13B:
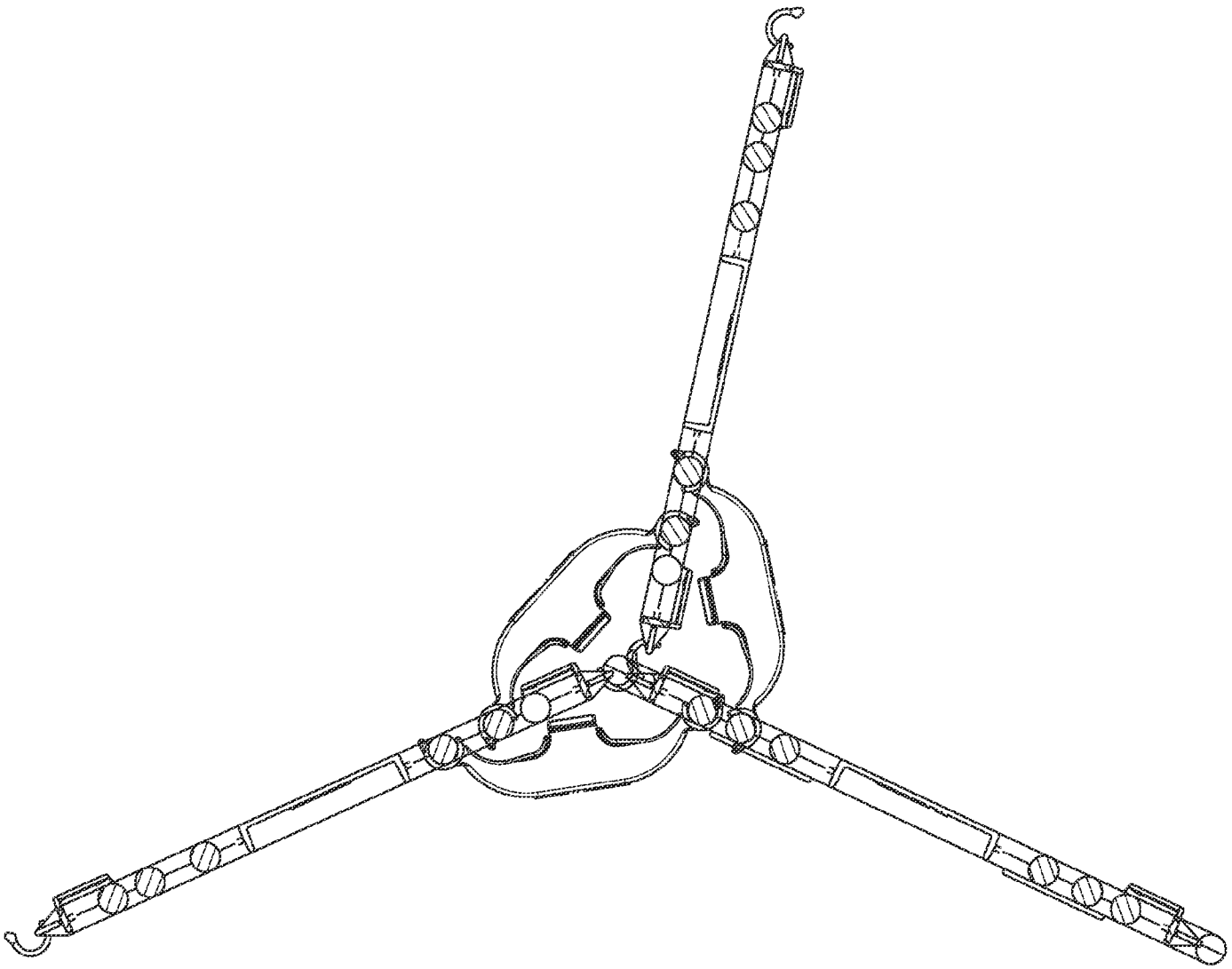

FIGS. 13A-13B illustrate other three-dimensional structures formed by three panels. FIG. 13 A shows a similar structure to that of FIG. 12. However, in the structure of FIG. 13, the third panel is not orthogonal to the two other panels. Rather, by coupling the two fixing members that are coupled to the third panel to various attachment members of all three panels, the relative angle of the third panel to the other two panels may be varied. FIG. 13B shows a structure where the three angles defined by the three panels are further varied. Note that as shown in FIGS. 13A-13B, the third panel need not be positioned at the interface between the other two panels.

Figure 14A:
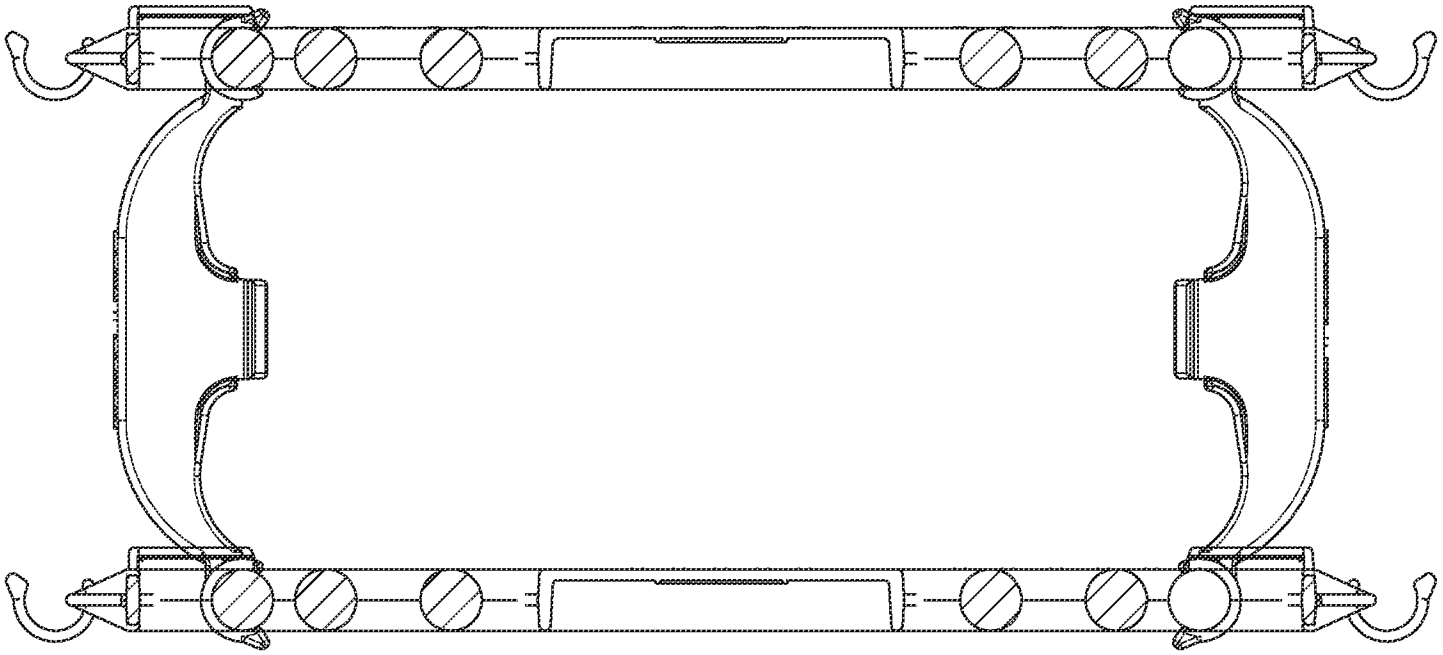
FIGS. 14A-14B illustrates two panels separated by two fixing members to form a three-dimensional hinge structure.
Figure 14B:
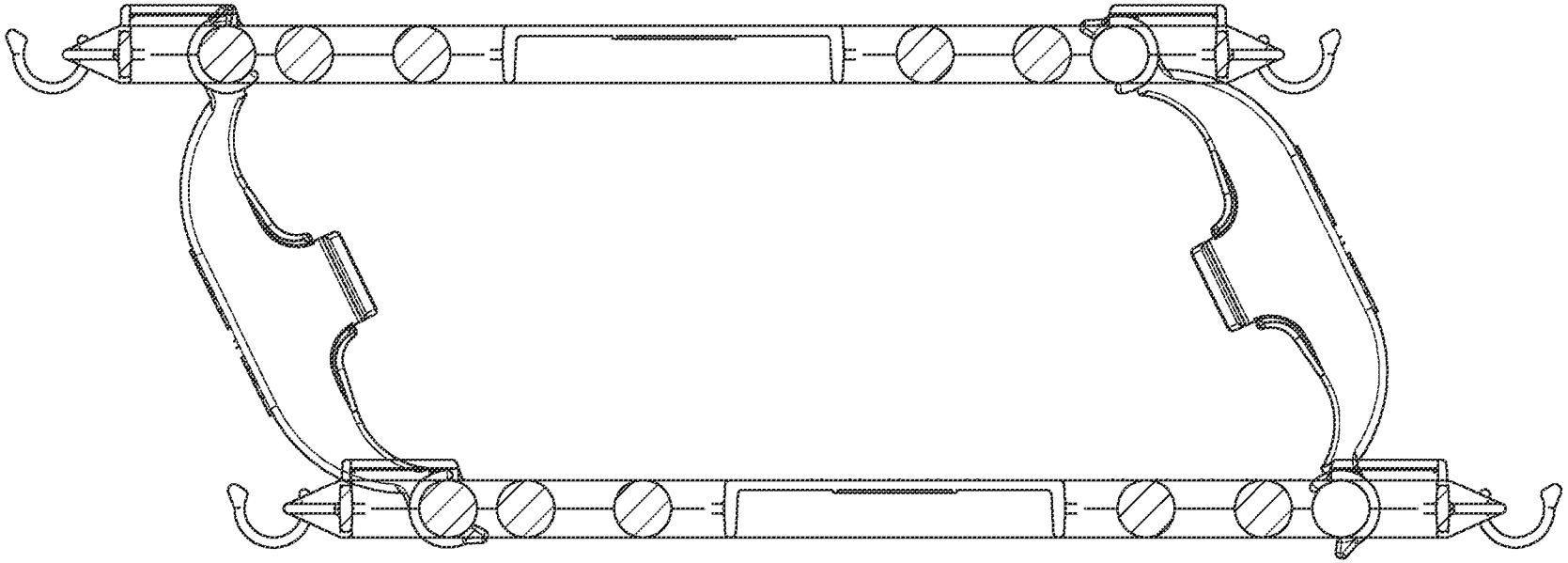
Figure 15A:
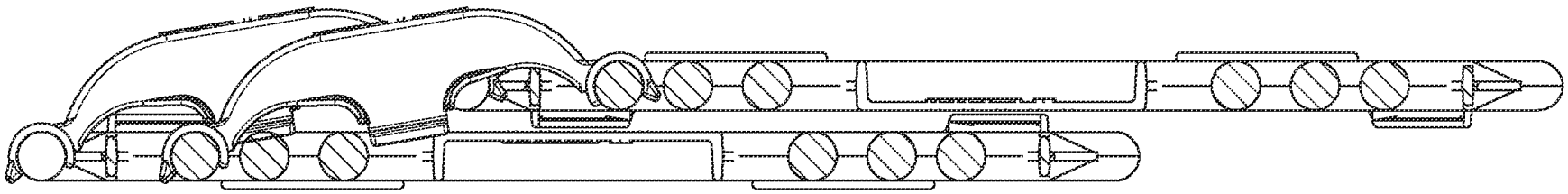
FIGS. 15A-15B show another hinge structure formed by two panels and three fixing members.
Figure 15B:
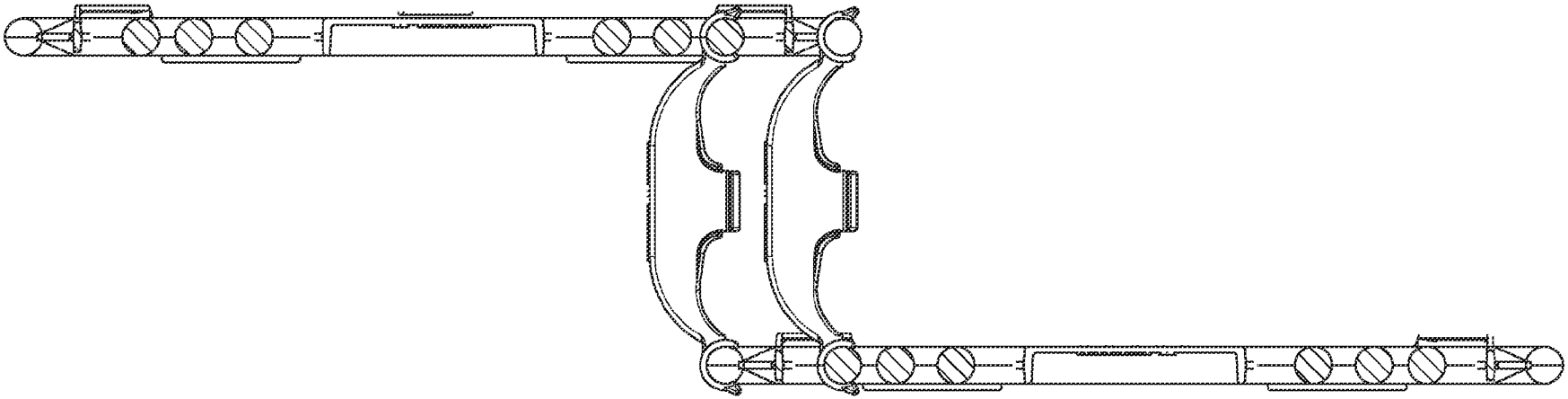

In preferable embodiments, when a fixing member is coupled to one of the attachment members of a panel, the fixing member can rotate about the attachment member because the female and male connectors form a hinge, in a manner that is similar to the hinge formed by the mating of the male and female edges of two panels. Accordingly, hinge-like structures may also be formed by panels and fixing members. FIGS. 14A-14B illustrate two panels separated by two fixing members to form a three-dimensional hinge structure. In FIG. 14A, the two panels are positioned such that one panel is directly above the other panel, with two fixing members, coupled to each of the panels separating the panels by a perpendicular distance that is approximately equal to the length of the fixing member. Each of the fixing members forms an angle with the panels that is approximately 90°. FIG. 14B shows that a shear force can rotate the hinge structure such that the fixing members form an angle with the panels other than 90°. When then angle is not equivalent to 90°, the perpendicular distance between the two panels is less than the length of the fixing member. The shear force rotates the hinge structure formed by the two panels and two fixing members. To form more complicated structures, other panels may be coupled to each of the two panels shown in FIGS. 14A-14B. FIGS. 15A-15B show another hinge structure formed by two panels and three fixing members.

FIGS. 16A-16B illustrates various three-dimensional structures formed by a plurality of panels 100 of FIGS. 1A-1B and fixing members 200 of FIGS. 2A-2B. For instance, FIG. 16A shows an igloo-like structure 1600 constructed from a plurality panels and fixing members. Likewise. FIG. 16B shows a fort-like structure 1650 constructed from a plurality panels and fixing members.

While the preferred embodiments of the invention have been illustrated and described, as noted above, many changes can be made without departing from the spirit and scope of the invention. Accordingly, the scope of the invention is not limited by the disclosure of the preferred embodiment. Instead, the invention should be determined entirely by reference to the claims that follow.

The embodiments of the invention in which an exclusive property or privilege is claimed are defined as follows:

1. A modular system for forming a rigid structure, the system comprising:

a first panel that includes a first edge and a first attachment member;

a second panel that includes a second edge and a second attachment member, wherein the second edge is configured and arranged to mate with the first edge of the first panel forming a hinge that couples the first and the second panels and enables a relative rotation about a rotation axis through the hinge, defining a relative angle between the first and the second panels; and a fixing member that is configured and arranged to couple to each of the first and the second attachment members when the relative angle between the first and the second panels is substantially equivalent to a first angle, fixing the relative angle at the first angle and forming at least part of the rigid structure, wherein the first angle is greater than 90° and less than 180°.

2. The system of claim 1, the second panel further includes a third attachment member and the fixing member is further configured and arranged to couple to each of the first and the third attachment members when the relative angle between the first and the second panels is substantially equivalent to a second angle, fixing the relative angle at the second angle.

3. The system of claim 1, wherein the first panel further includes a first channel that is substantially orthogonal to the first edge and the first attachment member is positioned within the first channel.

4. The system of claim 1, the first edge of the first panel includes a male coupler and the second edge of the second panel includes a female coupler, wherein the female coupler is configured and arranged to receive the male coupler and when received, the male and the female couplers form the hinge that couples the first and second panels.

5. The system of claim 1, the first panel further includes a third attachment member, wherein the first attachment member is positioned a first distance from the first edge, the second attachment member is positioned a second distance from the second edge, and the third attachment member is positioned a third distance from the first edge.

6. The system of claim 1, the fixing member includes a first coupler that is configured and arranged to receive the first attachment member of the first panel and a second coupler that is configured and arranged to receive the second attachment member of the second panel.

7. The system of claim 1, further comprising a planar member that includes a footprint that is substantially equivalent to a footprint of the first panel, wherein the first panel includes a coupler that is configured and arranged to couple the planar member to the first panel.

8. A kit for constructing a three-dimensional (3D) structure, the kit comprising:

a first substantially planar member that includes a first fastener and a first edge;

a second substantially planar member that includes a second fastener, a third fastener, and a second edge, wherein the second planar member is configured and arranged to rotatably couple to the first planar member along an interface between the first edge of the first planar member and the second edge of the second planar member, forming at least part of the 3D structure that includes a relative angle between the coupled first and second planar members; and a connector member, wherein when the connector member is connected to each of the first fastener of the of the first planar member and the second fastener of the second planar member, the relative angle between the coupled first and second planar members is fixed at a first angle and when the connector member is connected to each of the first fastener and the third fastener of the second planar member, the relative angle is fixed at a second angle.

9. The kit of claim 8, wherein the first fastener of the first planar member is a bar fastener.

10. The kit of claim 8, wherein the connector member is configured and arranged to provide tactile feedback when connecting to the first fastener of the first planar member.

11. The kit of claim 8, wherein the first edge of the of the first planar member includes a first notch, the second edge of the second planar member includes a second notch, and the connector member includes a reinforcing lip, wherein the first and the second notches form an aperture along the interface between the first and the second edges and the aperture is configured and arranged to receive the reinforcing lip when the relative angle between the coupled first and second planar members is substantially equivalent to 180° and when received by the aperture, the reinforcing lip reinforces the 3D structure.

12. The kit of claim 8, the second planar member further includes a fastener aperture, wherein each of the second and the third fasteners are positioned within the fastener aperture.

13. The kit of claim 8, the second planar member further includes a first marking positioned adjacent the second fastener and a second marking positioned adjacent the third fastener, wherein the first marking indicates the first angle and the second marking indicates the second angle.

14. The kit of claim 8, the first planar member further includes a reinforcing rib that is transverse to the first edge and reinforces the first planar member.

15. A modular assembly, the assembly comprising:

a first substantially rectangular module that includes a first edge;

a second substantially rectangular module that includes a second edge;

a hinge that is configured and arranged to rotatably couple the first and the second rectangular modules along the first and the second edges; and a locking device configured and arranged to inhibit a relative rotation about the hinge and between the first and the second rectangular modules when the locking device is coupled to each of the first and the second rectangular modules and, wherein the locking device locks a relative angle between the first and the second rectangular modules at a first angle when coupled to each of the first and the second rectangular modules in a first configuration and locks the relative angle at a second angle when coupled to each of the first and the second rectangular modules in a second configuration.

16. The assembly of claim 15, the hinge is further configured and arranged to provide tactile feedback when the first and second rectangular modules are coupled or de-coupled.

17. The assembly of claim 15, further comprising a graphic component that is configured and arranged to be attached to the first rectangular module.

18. The assembly of claim 15, wherein each of the first and the second rectangular modules are constructed from a plastic material.

19. The assembly of claim 15, wherein the hinge includes a male connector positioned along the first edge of the first rectangular module and a female connector positioned along the second edge of the second rectangular module.

20. The assembly of claim 15, wherein the first and the second configurations of the locking device coupled to the first and the second rectangular modules is based on the relative positions of a plurality of attachment members included in the first rectangular module and a second plurality of attachment members included in the second rectangular module.

* * * * *